US011459811B2

(12) United States Patent
Bantle

(10) Patent No.: US 11,459,811 B2
(45) Date of Patent: Oct. 4, 2022

(54) MOVEMENT ASSEMBLY

(71) Applicant: Karl Simon GmbH & Co. KG, Aichhalden (DE)

(72) Inventor: Ulrich Bantle, Mannheim (DE)

(73) Assignee: Karl Simon GmbH & Co. KG

( * ) Notice: Subject to any disclaimer, the term of this patent is extended or adjusted under 35 U.S.C. 154(b) by 518 days.

(21) Appl. No.: 16/500,454

(22) PCT Filed: Apr. 6, 2018

(86) PCT No.: PCT/EP2018/058906
§ 371 (c)(1),
(2) Date: Oct. 3, 2019

(87) PCT Pub. No.: WO2018/185311
PCT Pub. Date: Oct. 11, 2018

(65) Prior Publication Data

US 2020/0190882 A1 Jun. 18, 2020

(30) Foreign Application Priority Data

Apr. 6, 2017 (DE) ..... 10 2017 107 461.9

(51) Int. Cl.
*A47B 88/473* (2017.01)
*E05F 3/00* (2006.01)
(Continued)

(52) U.S. Cl.
CPC ..... *E05F 3/00* (2013.01); *A47B 88/46* (2017.01); *A47B 88/473* (2017.01); *E05F 5/003* (2013.01); *E05F 5/06* (2013.01)

(58) Field of Classification Search
CPC ..... A47B 88/46; A47B 88/473; E05F 3/00; E05F 5/003; E05F 5/06
See application file for complete search history.

(56) References Cited

U.S. PATENT DOCUMENTS 9,756,940 B2 9/2017 Chen et al.
2013/0104339 A1* 5/2013 Shimizu ..... E05F 1/16 16/72
(Continued)

FOREIGN PATENT DOCUMENTS

DE 102009021202 A1 2/2011
DE 102011050605 A1 11/2012
(Continued)

OTHER PUBLICATIONS

Russia Office Action for corresponding patent application No. 2019135234, dated Mar. 23, 2020, 2 pages (not prior art).
(Continued)

*Primary Examiner* — James O Hansen
(74) *Attorney, Agent, or Firm* — Lucian Wayne Beavers; Patterson Intellectual Property Law, PC

(57) ABSTRACT

The invention relates to a movement assemblage, in particular for a drawer, a sliding door, a hinged door, a hatch, or a similar movable furniture part, having a push-out assemblage; the push-out assemblage comprising a guide element (90) on which an energy reservoir (80) acts; the guide element (90) being displaceable from a parked position into an ejection position; and a switching piece (99), which is displaceable with respect to the guide element (90), being attached to the guide element (90). For improved movement guidance, provision is made according to the present invention that the switching piece (99) comprises a guide element (99.4) that is guided in a guide track (74) of the fitting.

15 Claims, 17 Drawing Sheets

(51) Int. Cl.

| | |
|---|---|
| ***A47B 88/46*** | (2017.01) |
| ***E05F 5/00*** | (2017.01) |
| ***E05F 5/06*** | (2006.01) |

(56) References Cited

U.S. PATENT DOCUMENTS

| | | | | |
|---|---|---|---|---|
| 2015/0108891 | A1* | 4/2015 | Brunnmayr ..... | A47B 88/457<br>312/319.8 |
| 2016/0227927 | A1 | 8/2016 | Goetz | |
| 2017/0135478 | A1 | 5/2017 | Chen et al. | |

FOREIGN PATENT DOCUMENTS

| | | | |
|---|---|---|---|
| DE | 102011054441 | A1 | 4/2013 |
| EP | 2292119 | A1 | 3/2011 |
| EP | 1819256 | B1 | 8/2015 |
| RU | 2366351 | C2 | 9/2009 |
| TW | I538638 | B | 6/2016 |
| WO | 2014165878 | A1 | 10/2014 |

OTHER PUBLICATIONS

International Search Report for corresponding PCT No. PCT/EP2018/058906, dated Jun. 4, 2018, 10 pages (not prior art).
Office Action dated Jan. 9, 2018 in corresponding German patent application 102017107461.9, 8 pages (not prior art).

* cited by examiner

MOVEMENT ASSEMBLY

The invention relates to a movement assemblage, in particular for a drawer, a sliding door, a hinged door, a hatch, or a similar movable furniture part, having a push-out assemblage; the push-out assemblage comprising a guide element on which an energy reservoir acts and which is guided in or on a fitting, in particular a housing; the guide element being displaceable by means of the energy reservoir from a parked position into an ejection position; and a switching piece, which is displaceable with respect to the guide element, being attached to the guide element.

DE 10 2009 021 202 B4 discloses a movement assemblage for a drawer. A pull-in apparatus and a push-out assemblage are used in this movement assemblage. The pull-in apparatus comprises a housing in which a coupling element is displaceable, against the preload of a spring, between a pulled-in position and a parked position. The coupling element can correspondingly be pulled from the parked position into the pulled-in position. The pulling-in movement can be damped with a damper that is accommodated in the pull-in apparatus. The push-out assemblage possesses a guide element that comprises a coupling piece. The coupling piece can be brought into operative engagement with the coupling element of the pull-in apparatus. The push-out assemblage furthermore encompasses an ejection spring. By means of the latter, the coupling element can be shifted between a closed position and a pulled-out position. A further fitting, which is fastened together with the pull-in apparatus onto a first furniture part, for example a drawer, is used. The push-out apparatus is mounted on the second furniture part, for example the furniture carcass. The pull-out assemblage comprises a switching piece that interacts with the further fitting for movement control.

The object of the invention is to furnish a movement assemblage of the kind mentioned initially which is notable for a compact design.

This object is achieved in that the switching piece comprises a guide element that is guided in a guide track of the fitting. The result of the physical association of the switching piece with the guide element is firstly to reduce complexity in terms of parts and installation. More unequivocal and more reliable movement control is also achieved.

According to a preferred variant of the invention, provision can be made that a slider acts on the switching part in order to displace the guide element over at least part of the travel from the ejection position toward the parked position.

The slider considerably reduces complexity in terms of parts and installation, since it is possible to omit the further fitting that is known from the existing art.

According to a particularly preferred variant embodiment of the invention, provision is made that the guide element and the slider are displaceable together on a fitting, preferably in a housing. This results in particularly simple installation. The slider and the guide element are moreover associated in accurately dimensionally fitted fashion with one another on the one fitting, which guarantees reliable operation.

Accurate movement guidance for the slider can be achieved in simple fashion by the fact that the slider comprises at least one guide piece by means of which it is guided in a guide of the fitting, in particular of the housing.

Stable guidance of the slider is guaranteed if provision is made that the slider comprises, on its two oppositely located sides, a respective guide part on a guide holder, which parts are respectively guided in a guide of the fitting, in particular of the housing.

In the interest of a compact design, provision can furthermore be made that the slider comprises a protruding switching extension. This switching extension can then be triggered by an activator that is preferably arranged on the pull-in apparatus. The activator can also, of course, be coupled not directly to the pull-in apparatus but instead indirectly thereto. It is conceivable for the activator to be fastened in another manner onto the furniture component on which the pull-in apparatus is also arranged. This also encompasses designs in which the activator is mounted on a pull-in guide coupled to that furniture part.

A further variant of the invention can be such that the second switching part comprises a delimiting element that, in one switched position of the second switching piece, comes to a stop against a displaceable immobilizing part. This makes it possible to immobilize the second switching piece in the movement sequence, in order to make possible a relative movement between the slider and the guide element in controlled fashion. If provision is made in this context that the immobilizing part is actuatable against a countermember in order to displace it from a immobilized position into a released position and/or conversely from a released position into a immobilized position, it can then be displaced in simple fashion, for example with the aid of a stop, between its two operating positions. That stop can be coupled to the furniture part onto which the push-out assemblage is not fastened.

A particularly simple design can be achieved by the fact that the immobilizing part is held on the guide element and is displaceable therewith.

According to a variant of the invention, provision can be made in particular that the housing comprises a guide for the slider, the guide comprising a parking portion that transitions into a longitudinal guide; and that the slider is held, in the parked position, in a tipped-over parked position. In its tipped-over position, the slider is released. For example, the slider can be released here when the drawer moves from its closed position toward its open position. With the guide, the slider can be simply and reliably positioned between its individual switched positions.

One conceivable variant of the invention is such that the second switching piece is guided in a guide track; that the guide track comprises a guide portion that forms a longitudinal guide and comprises a further guide portion that forms a return guide; and that these two guide portions transition into one another, in particular with a transition portion and a transition region.

A particularly preferred variant of the invention is such that the movement assemblage comprises a pull-in apparatus, the pull-in apparatus comprising a coupling element that is displaceable between a pulled-in position and an extended position; that the coupling element is couplable to the guide element; and that an actuation piece that acts on the immobilizing part is attached to the pull-in apparatus. Additionally or alternatively, provision can be made that the movement assemblage comprises a pull-in apparatus, the pull-in apparatus comprising a coupling element that is displaceable between a pulled-in position and an extended position; that the coupling element is couplable to the guide element; and that a stop that acts on the slider is attached to the pull-in apparatus. These embodiments of the invention utilize two fittings, namely the pull-in apparatus on the one hand and the extension apparatus on the other. Minimum complexity in terms of parts is thereby achieved. Each one of the fittings can be fastened onto one furniture part. For example, the first fitting can be fastened onto a drawer, and the second fitting onto the carcass. Control of the movement of the slider and of the immobilizing part can be accomplished in simple fashion using respectively the stop and the actuation piece. Particularly preferably, the stop and the actuation piece are coupled directly onto the pull-in apparatus. They can of course also be connected indirectly to the pull-in apparatus, for example suitably fastened onto a pull-in guide or fastened onto the furniture part on which the pull-in apparatus is also mounted.

The invention will be explained in further detail below with reference to exemplifying embodiments depicted in the drawings, in which:

FIG. 2 shows the pull-in apparatus in a position corresponding to a fully open position of the drawer;

FIG. 3 shows the pull-in apparatus in a position corresponding to a partly closed position of the drawer;

FIG. 4 shows the pull-in apparatus in a position corresponding to a further closed position of the drawer;

FIG. 5 shows the pull-in apparatus in a position corresponding to a still further closed position of the drawer;

FIG. 6 shows the pull-in apparatus in a position corresponding to a completely closed position of the drawer;

FIG. 7 is an enlarged view of the circled area of FIG. 6;

FIG. 8 shows the first step in the initiation of an opening sequence of the drawer;

FIG. 9 shows the energy reservoir beginning to push the drawer open;

FIG. 10 shows the drawer partly opened to a position where the drawer can be grasped to be further pulled out manually;

FIG. 11 shows the drawer partly pulled out manually;

FIG. 12 shows the drawer pulled out to a completely open position;

FIG. 13 shows the beginning of a closing operation;

FIG. 14 shows a fully closed position;

FIG. 15 shows the beginning of an opening operation;

FIG. 16 shows a fully open position;

FIG. 17 is a perspective exploded view of the third variant embodiment;

FIG. 18 is a side view showing the pull-in apparatus in a position corresponding to a fully open position of the drawer;

FIG. 19 shows the pull-in apparatus in a position corresponding to a partly closed position of the drawer;

FIG. 20 shows the pull-in apparatus in a position corresponding to a further closed position of the drawer;

FIG. 21 shows the pull-in apparatus in a position corresponding to a still further closed position of the drawer;

FIG. 22 shows the pull-in apparatus in a position corresponding to a still further closed position of the drawer;

FIG. 23 shows the pull-in apparatus in a position corresponding to a completely closed position of the drawer;

FIG. 24 shows the first step in the initiation of an opening sequence of the drawer;

FIG. 25 shows the energy reservoir beginning to push the drawer open;

FIG. 26 shows the drawer in a further open position;

FIG. 27 shows the drawer partly opened to a position where the drawer can be grasped to be further pulled out manually;

Figure 1:
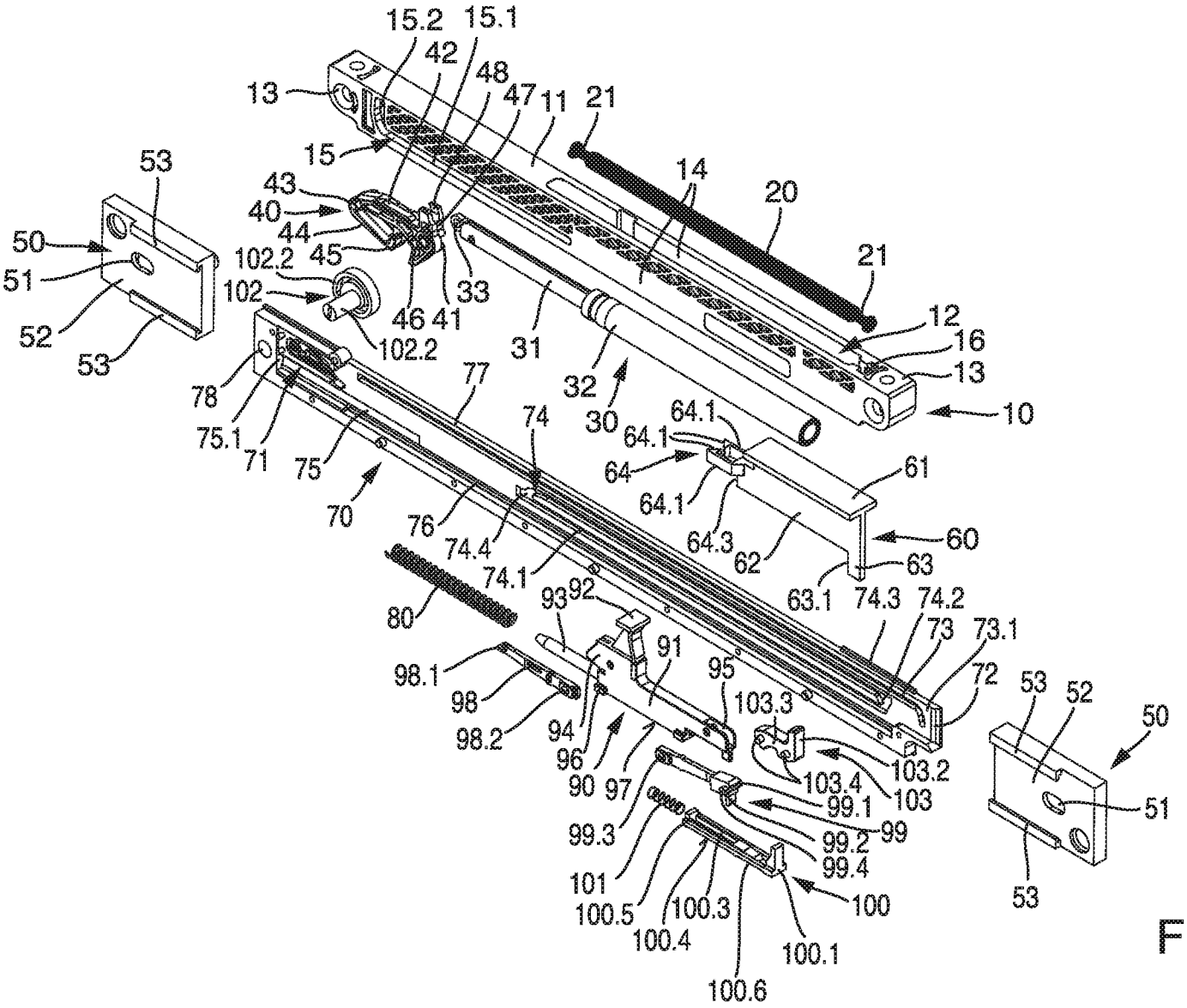
FIG. 1 is an exploded perspective depiction of a movement assemblage.
Figure 30:
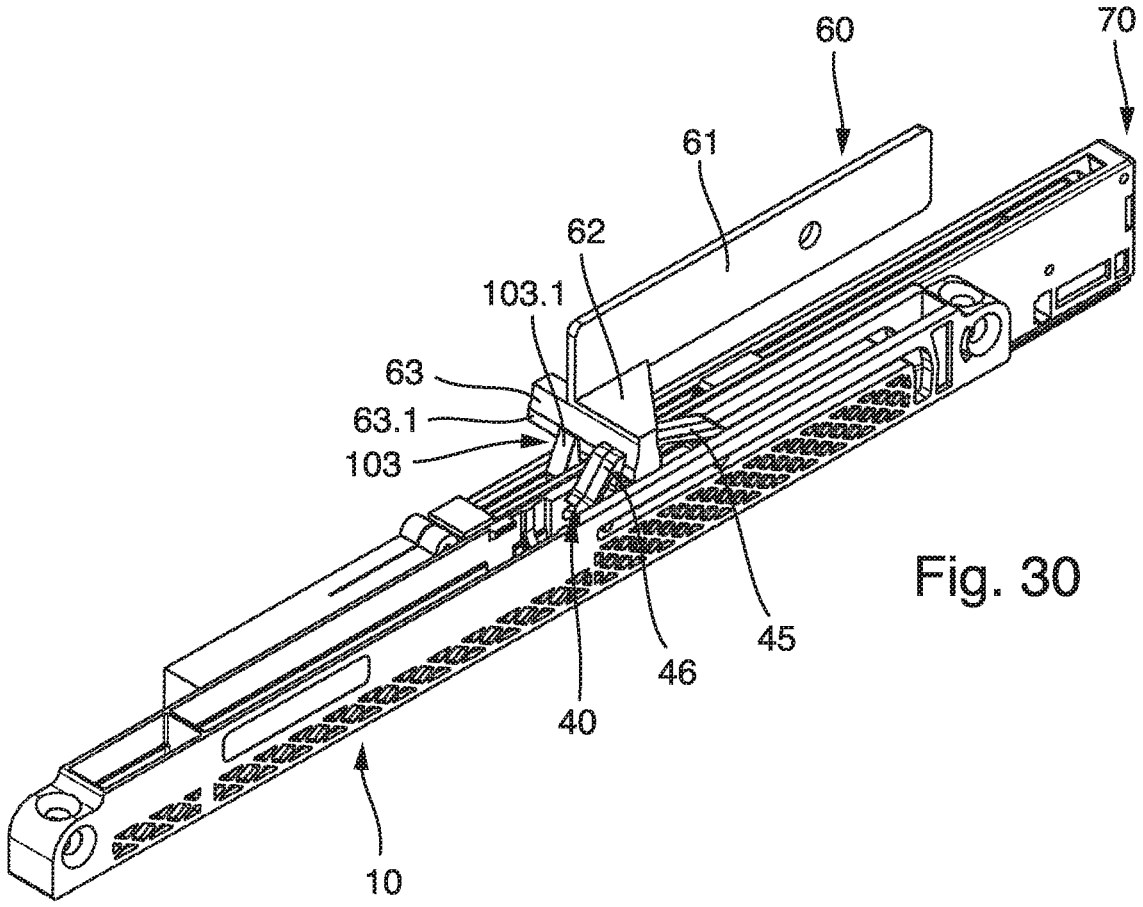
FIG. 30 is a perspective view of a fifth variant embodiment with the pull-in apparatus and the push-out assemblage installed together on one fitting.

FIG. 1 shows a movement assemblage that is utilized, for example, in the context of drawers. Utilization with other components that need to be moved, for example doors, hatches, etc., is also conceivable. The movement assemblage encompasses a pull-in apparatus 10 and a push-out assemblage. Pull-in apparatus 10 can be arranged, for example, on a drawer, and the push-out assemblage on a furniture carcass in which the drawer is accommodated. It is of course also possible to fasten the pull-in apparatus onto the furniture carcass and the push-out assemblage onto the drawer. It is furthermore possible to mount the pull-in apparatus or the push-out arrangement indirectly on the furniture part, for example on the mutually movable guide parts of a pull-out guide. It is furthermore conceivable to arrange both pull-in apparatus 10 and the push-out assemblage, indirectly or directly, together on one furniture part, i.e. for example on a drawer or a furniture carcass. It is also conceivable for both units to be combined on one fitting that can be handled in unitary fashion, as shown in FIG. 30.

As FIG. 1 shows, pull-in apparatus 10 comprises a housing 11 that carries a respective fastening piece 13 at its longitudinal ends. Each fastening piece 13 comprises a screw receptacle. By way of the screw receptacles, pull-in apparatus 10 can be mounted on the respective furniture part, in the present exemplifying embodiment on the drawer. Housing 11 has two walls 14, spaced apart parallel to one another, into which guides 15 are recessed. Guides 15 comprise a slot-shaped aperture that forms a guide portion 15.1. Guide portion 15.1 transitions into a curved locking portion 15.2. Guides 15 of the two walls 14 line up with one another.

A damping apparatus 30 is accommodated in housing 11. Damping apparatus 30 comprises a cylinder 32 in which a piston is displaceably accommodated. The piston is coupled onto a piston rod 31. The piston rod has, at its longitudinal end, a connecting piece 33. Damping apparatus 30 can be embodied as a fluid damper. An air damper is used in the present case. A liquid damper, for example an oil damper, can of course also be used. The use of an air damper has the advantage that in the event of damage, no liquid can emerge and soil the drawer contents. Damping apparatus 30 is shown in FIG. 1 in the pulled-out position. Upon movement back from the pulled-out position shown in FIG. 1 into a pulled-in position, the piston works against an air cushion, an air pressure being continuously dissipated. A small opening is present for that purpose in cylinder 32. The compressed air can escape in controlled fashion through that opening.

Connecting piece 33 forms, together with a coupling element 40, a pivot bearing, the pivot axis proceeding transversely to the longitudinal extent of guide portion 15.1. Coupling element 40 is equipped for that purpose with a bearing receptacle onto which connecting piece 33 of piston rod 31 can be pivotably coupled. Coupling element 40 possesses a base part 41. An extension 42, for example in the form of an extension arm, projects from base part 41. At its end facing away from base part 41, extension 42 is attached resiliently to a deflection part 44. Deflection part 44 forms a stop 45. A further stop 46 is provided on base part 41. The two stops 45, 46 are arranged with a spacing from one another so that a receiving space is produced between them. Coupling element 40 carries, on oppositely located sides, guide elements 43. These guide elements 43 are inserted into the two oppositely located guides 15. Coupling element 40 furthermore comprises two guide parts 47 that protrude laterally. These guide parts 47 as well are inserted into guides 15. In the interest of a compact design, the pivot axis of the aforesaid pivot bearing proceeds through the two guide parts 47. It is also conceivable for coupling element 40 to comprise only one guide element 43 and/or only one guide part 47. In particular, guide element or elements 43 and guide part or parts 47 do not need to be arranged on both sides, but instead can be arranged on only one side. Lastly, coupling element 40 also possesses a spring holder 48. A spring 20 can be fastened onto spring holder 48 with a fastening portion 21. Spring 20 comprises a second oppositely located fastening portion 21. With this second fastening portion 21, spring 20 is fastened onto a spring holder 16 of housing 11. In the installed state, spring 20, damping apparatus 30, and coupling element 40 are accommodated in housing 11 of pull-in apparatus 10. It is also conceivable for spring 20 and/or damping apparatus 30 to be held partly or completely outside housing 11.

A follower 60 can furthermore be coupled to pull-in apparatus 10. Follower 60 is fastened onto housing 11. It is also possible for follower 60 to be connected as one piece with housing 11. This results in a reduced outlay in terms of parts and installation. It is furthermore also conceivable for follower 60 to be coupled fixedly onto the furniture part or onto that part of a pull-out guide onto which the pull-in apparatus is also indirectly or directly coupled.

In the present case, follower 60 comprises a connecting portion 61 with which it is fastened onto housing 11 of pull-in apparatus 10.

A spacer 62 is shaped onto follower 60. Spacer 62 carries an actuation piece 63 having a stop 63.1. A switching piece 64.3 can furthermore also be arranged on follower 60. As is evident from FIG. 1, follower 60 possesses an extension 64. In the present exemplifying embodiment, extension 64 is constituted by two limbs 64.1 spaced away from one another. The two limbs 64.1 encompass a receiving region. Adjacently to the receiving region, limbs 64.1 each comprise a projection 64.2. Extension 64 need not comprise two limbs as shown in FIG. 1. It is instead possible to use only a single extension 64 that comprises a projection 64.2.

Figure 1A:
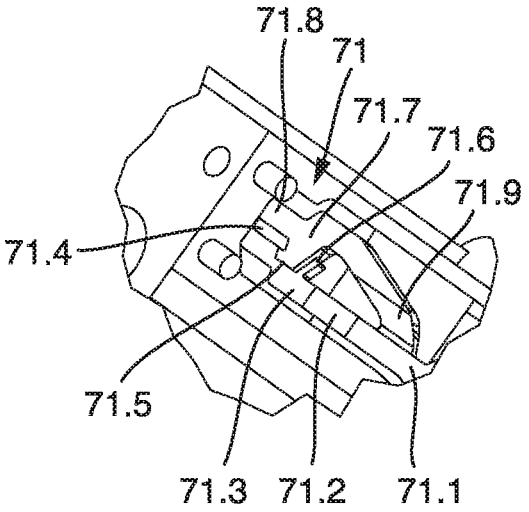
FIG. 1A is an enlarged view of the switching module of FIG. 1.

The construction of the push-out assemblage will be explained in further detail below with reference to FIG. 1. As this illustration shows, the push-out assemblage comprises a housing part 70. This housing part 70 can be installed onto a further housing part (not depicted) to form a housing. The further housing part, like housing part 70, has an elongated conformation. Housing part 70 comprises a switching module 71 that is shown in more detail in FIG. 1*a*; switching module 71 has an opening 71.1. Adjacently to opening 71.1, the switching module forms a sliding surface that transitions into a ramp 71.2. Ramp 71.2 rises as far as a guide portion 71.3. Guide portion 71.3 carries an extension 71.4 that rises from the planar guide portion 71.3. In addition, a holding portion 71.6 is arranged on a protrusion in the region of guide portion 71.3. A step 71.5 is arranged between holding portion 71.6 and extension 71.4. Step 71.5 provides a transition from guide portion 71.3 into the region of a surface portion 71.7 that is arranged slightly lower down than guide portion 71.3. An overtravel position 71.8 is constituted in the region of surface portion 71.7. Surface portion 71.7 is guided around the extension that forms holding portion 71.6. In the region of a runout region 71.9, surface portion 71.7 transitions into the surface region facing toward opening 71.1. Switching module 71 can be inserted as a separate component into housing part 70. It is also conceivable, as shown in the present exemplifying embodiment, for switching module 71 to be shaped as one piece onto housing part 70, resulting in a reduced outlay in terms of parts and installation. The open side, shown in FIG. 1*a*, of switching module 71 is covered by the further housing part in the installed state, so that the interior of switching module 71 is accessible through opening 71.1. It is of course also conceivable for a separate cover to be provided in order to cover switching module 71.

As is further evident from FIG. 1, housing part 70 comprises a guide 73. Guide 73 is introduced in the form of a groove into housing part 70. A guide 73 of identical design can be provided on the further housing part, guides 73 being located opposite one another when the housing is in the installed state. Guide 73 comprises a longitudinal guide 73.2 that transitions into an angled parking portion 73.1.

The housing comprises a guide track 74 in housing part 70. Guide track 74 is introduced in the form of a groove into housing part 70. A guide track 74 of the same design can be provided on the further housing part, guide tracks 74 being located opposite one another when the housing is in the installed state. Guide tracks 74 comprise a guide region 74.3 and a return guide 74.1 proceeding parallel thereto. Guide region 74.3 transitions, via a transition portion 74.2 and a transition region 74.4, into return guide 74.1. This results in a circulating groove guide.

Lastly, housing part 70 also comprises a spring receptacle 75. A groove 76 can furthermore be recessed into housing part 70. The further housing part can likewise comprise, complementarily thereto, a spring receptacle 75 and a groove 76. An energy reservoir 80, in the present case e.g. a compression spring, can be inserted into spring receptacle 75. Energy reservoir 80 is held between housing parts 70. At its one end, energy reservoir 80 braces against a body region 75.1 of housing part 70.

A guide element 90 can be built into housing 70. Guide element 90 comprises a base body 91 to which a coupling piece 92 is attached. Guide element 90 furthermore possesses a pin 93 onto which energy reservoir 80, embodied as a spring, can be placed. Guide element 90 comprises two holders 94, 95. A first switching piece 98 is fastened pivotably onto holder 94. Switching piece 98 comprises for that purpose a bearing 98.2 that is secured in a bearing receptacle of holder 94.

At its end facing away from bearing 98.2, first switching piece 98 possesses a guide extension 98.1.

A second switching piece 99 is pivotably fastened onto second holder 95. Second switching piece 99 comprises a bearing 99.3 that is secured in a bearing receptacle of holder 95. At its end facing away from bearing 99.3, second switching piece 99 possesses a guide element 99.4. The guide element 99.4 may also be referred to as a switching piece guide structure 99.4. As shown in FIG. 1, guide element 99.4 can be shaped onto a head 99.1. Second switching piece 99 comprises a delimiting element 99.2 that protrudes downward. The two switching pieces 98 and 99 each show in FIG. 1 the protruding guide extension 98.1 and the protruding guide element 99.4. In the interest of completeness, it is noted here that a respective guide extension 98.1 and a respective guide element 99.4 can be provided on both sides of the two switching pieces 98, 99.

Figure 2:
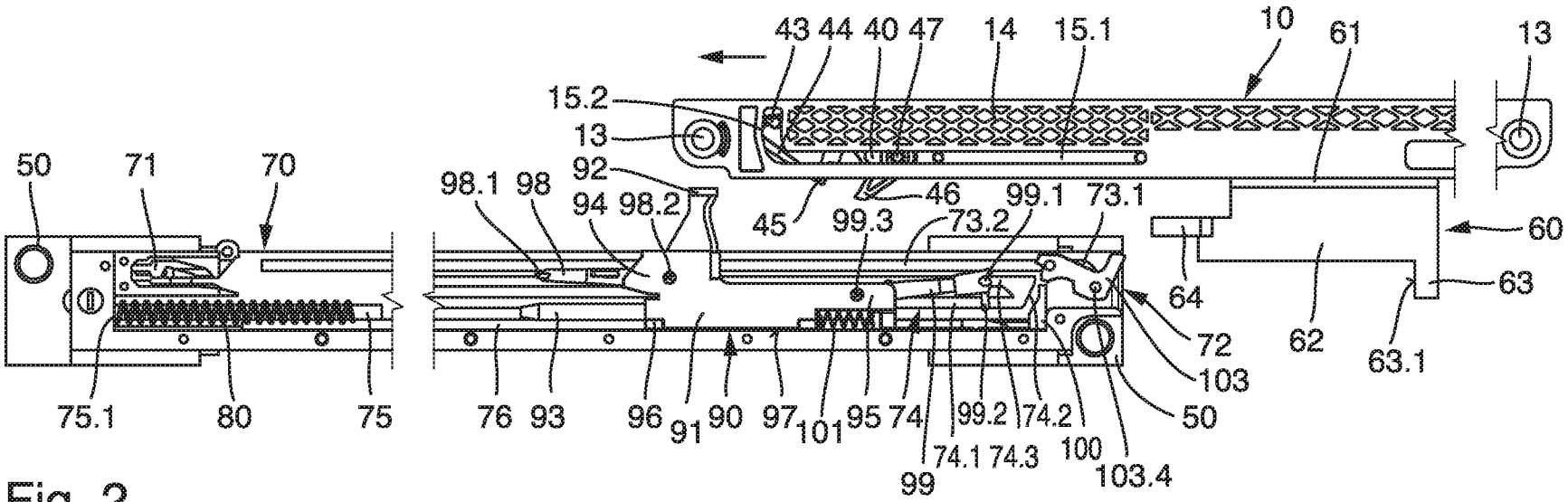
FIGS. 2 to 12 are side views showing various switched positions of the movement assemblage according to FIG. 1.

Guide element 90 is equipped with laterally projecting guide elements 96. Guide elements 96 preferably project on both sides of guide element 90. As depicted in FIG. 1, only guide elements 96 projecting to one side are recognizable. The underside of guide element 90 can form a guide surface 97. For installation of guide element 90, firstly the two switching pieces 98, 99 are pivotably fastened onto guide element 90. Energy reservoir 80 is then slid onto pin 93. As is evident from FIG. 2, guide element 90 having guide element or elements 96 of one side can be inserted into groove 76 of housing part 70. Guide surface 97 rests on an associated guide surface of housing part 70, thereby forming a longitudinal guide within which guide element 90 can be shifted in the image plane as shown in FIG. 2. The two guide elements 96 evident in FIG. 2 engage into a corresponding groove of the further housing part when the two housing parts 70 are connected to one another. Retained accommodation of guide element 90 is thereby guaranteed.

Below second switching piece 99, an immobilizing part 100 is held on guide element 90. Immobilizing part 100 comprises a projecting countermember 100.1. A receptacle 100.2 is provided adjacently to countermember 100.1. Receptacle 100.2 comprises a portion that forms a setback 100.6. Adjacently to receptacle 100.2, a guide receptacle 100.3 is provided for linear guidance on guide element 90. Guide receptacle 100.3 is delimited by two lateral guide extensions 100.4. Adjoining guide extensions 100.4 is a support part 100.5. As is evident from FIG. 2, immobilizing part 100 rests with its underside, like guide element 90, on the guide surface of housing part 70 so as to constitute a longitudinal guide. Provision can furthermore be made that immobilizing part 100 likewise engages with projections into groove 76 of housing part 70 in order to hold it in captive fashion. Guide element 90 possesses a spring receptacle into which a spring 101 is inserted. Spring 101 braces at its one end against a body edge of guide element 90. At the other end, the spring abuts against support part 100.5. Immobilizing part 100 can be displaced with respect to guide element 90, specifically against the tensioning force of spring 101.

With guide element 90 in the installed state, first switching piece 98 engages, with its guide extensions 98.1 on both sides, into guides 73 of housing parts 70. Second switching piece 99 engages, with its guide elements 99.4 projecting on both sides, into guides 74 of housing parts 70.

Slider 103 can be inserted, with its guide pieces 103.4 projecting on both sides, into guides 73 of housing parts 70.

When the two housing parts 70 are connected to one another, the push-out assemblage is configured in a preinstalled state.

Two holders 50 are used to fasten the push-out assemblage onto the desired furniture part. Holders 50 comprise a plate 52 that forms guides 53 on opposite sides, an oblong hole 51 being introduced into the plate. With the two guides 53, holders 50 at oppositely located ends of the push-out assemblage can be slid onto flanges 77 of housing part 70. A positioning member 102 can be installed onto housing part 70 from the back side. Positioning member 102 has a cam, the latter being constituted by a stud 102.1 and a bearing plate 102.2. Bearing plate 102.2 abuts at the back against plate 52 of holder 50, and is rotatably supported there in a bearing guide. Stud 102.1 can be inserted through oblong hole 51 of holder 50 and through an orifice 78, in line therewith, of housing part 70. As is evident from FIG. 1, stud 102.1 comprises a tool receptacle. A linear displacement of housing part 70 with respect to holder 50 can be effected by rotating stud 102.1. It is thereby possible to displace the position of the push-out assemblage in a longitudinal direction, for example in order to adjust the gap dimension between a drawer front and the furniture carcass.

The operation of the movement assemblage will be explained in more detail below with reference to FIGS. 2 to 12. FIG. 2 shows the open position of the drawer. Coupling element 40 of pull-in apparatus 10 is pulled out. Guide elements 43 are accordingly located in the region of locking portion 15.2. Guide parts 47 are held in the region of guide portion 15.1. Spring 20 is under load, and damping apparatus 30 is pulled out. Follower 60 is out of engagement with the push-out assemblage.

As is evident from FIG. 2, guide element 90 is arranged in the region of the right side of housing part 70. Guide extensions 98.1 of first switching piece 98 are held in longitudinal guides 73.2 of guides 73. Guide elements 99.4 of second switching piece 99 are held in the region of guide regions 74.3 of guide tracks 74. Spring 101 pushes immobilizing part 100 into the position shown, and immobilizing part 100 braces with its countermember 100.1 against a body edge of housing part 70. Energy reservoir 80 is in its relaxed position.

Figure 3:
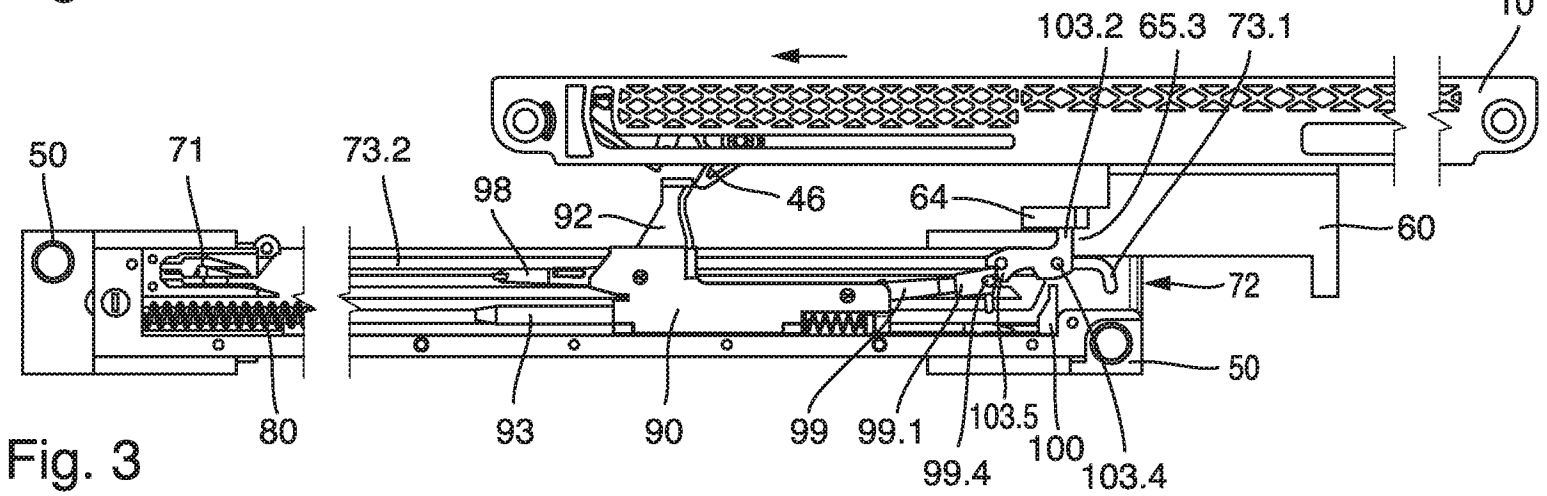

The movement sequence upon closing of the drawer will now be explained below, that sequence being indicated by way of the arrows depicted in FIG. 2. The drawer on which pull-in apparatus 10 is installed is therefore closed in the arrow direction. During this movement, follower 60 travels through an opening 72 in the housing constituted by housing parts 70. When follower 60 approaches the push-out assemblage, switching piece 64.3 of follower 60 then strikes against switching extension 103.2 of slider 103, as shown in FIG. 2. As a result of the movement of follower 60, slider 103 is thus moved out of its parked position shown in FIG. 2. In that context, guide pieces 103.4 held in parking portions 73.1 in the tipped-over position of slider 103, as well as the two front guide pieces 103.4, come into the region of longitudinal guide 73.2 of guide 73, as shown by FIG. 3. After a short displacement travel of slider 103, the latter strikes with its stop 103.5 against a counterpart stop of head 99.1 of second switching piece 99. As FIG. 3 further shows, coupling piece 92 is held by way of follower 60, slider 103, second switching piece 99, and guide element 90 in a fixed association with respect to pull-in apparatus 10. This means that in that position, coupling piece 92 cannot be displaced relative to pull-in apparatus 10. It therefore abuts against stop 46 of coupling piece 40 but cannot displace coupling piece 40. As the drawer continues to close, pin 93 penetrates into energy reservoir 80 and guide element 90 becomes further displaced, specifically against the force of energy reservoir 80. This is apparent from FIG. 3.

While energy reservoir 80 is being put under load, first switching piece 98 also moves with its guide extension 98.1 into switching module 71. This occurs at the transition from FIG. 3 to FIG. 4, in which first switching piece 98 passes with its guide extension 98.1 through opening 71.1 and slides upward over ramp 71.2 onto guide portion 71.3. Guide extension 98.1 is held by pressure on guide portion 71.3, oppositely to holding portion 71.6.

Guide element 90 becomes loaded against energy reservoir 80 until guide elements 99.4 of second switching piece 99 are displaced into transition region 74.4. Switching piece 99 then becomes pivoted, clockwise in FIG. 3, a little farther downward. The immobilization between slider 103 and second switching piece 99 is thereby canceled. The pivoting movement of second switching piece 99 is thus possible to only a limited extent. To prevent second switching piece 99 from moving into the region of return guide 74.1, delimiting element 99.2 comes to a stop against a surface of receptacle 100.2 of immobilizing part 100. This is evident from FIG. 5. As this Figure further shows, the pivoting of second switching piece 99 creates enough room that slider 103 can be moved past second switching piece 99 in guide 73. When the immobilization between slider 103 and second switching piece 99 is canceled, however, the fixed association between coupling piece 92 and pull-in apparatus 10 is also canceled. A relative movement therefore occurs between coupling piece 92 and pull-in apparatus 10. Pull-in apparatus 10 then pulls the drawer, with its spring 20, toward the closed position. First switching piece 98 is now, with its guide extension 98.1, in overtravel in switching module 71 until stop 63.1 releases second switching piece 99 by pushing immobilizing part 100 forward. Energy reservoir 80 then pushes guide extension 98.1 of first switching piece 98 onto holding portion 71.6. In the overtravel position, slider 103 cannot be unlocked by applications of external force to the drawer, since it is immobilized in that position. It is therefore, in particular, prevented from inadvertently initiating an ejection operation.

Figure 4:
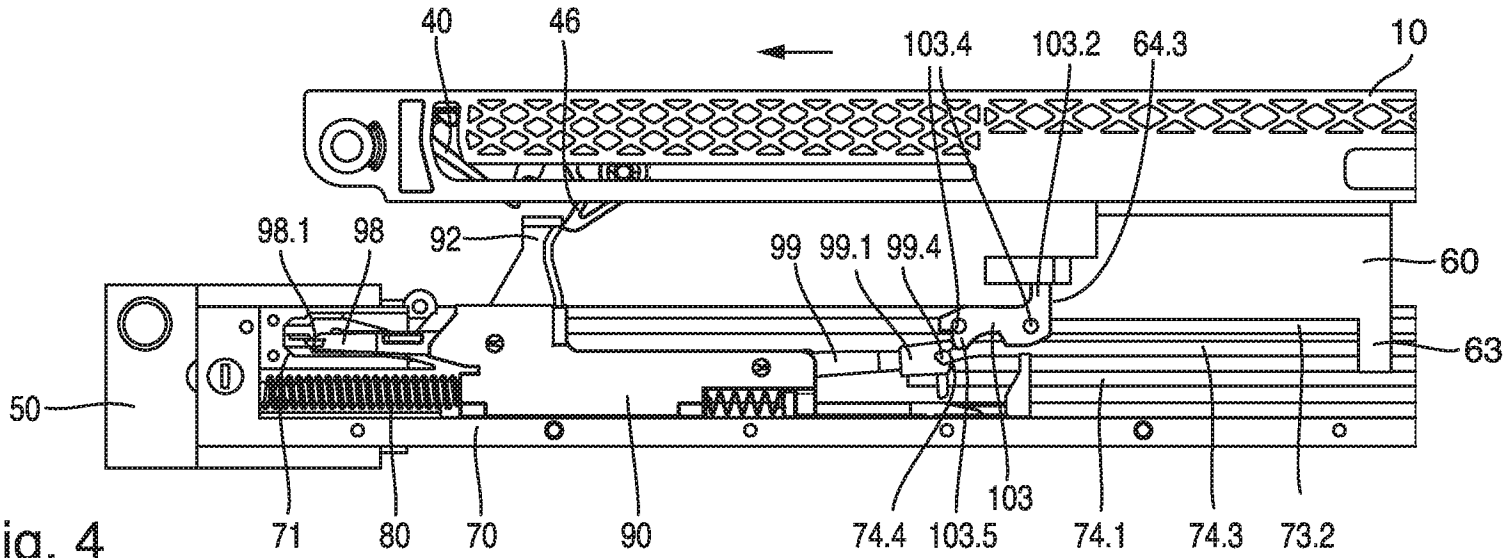
Figure 5:
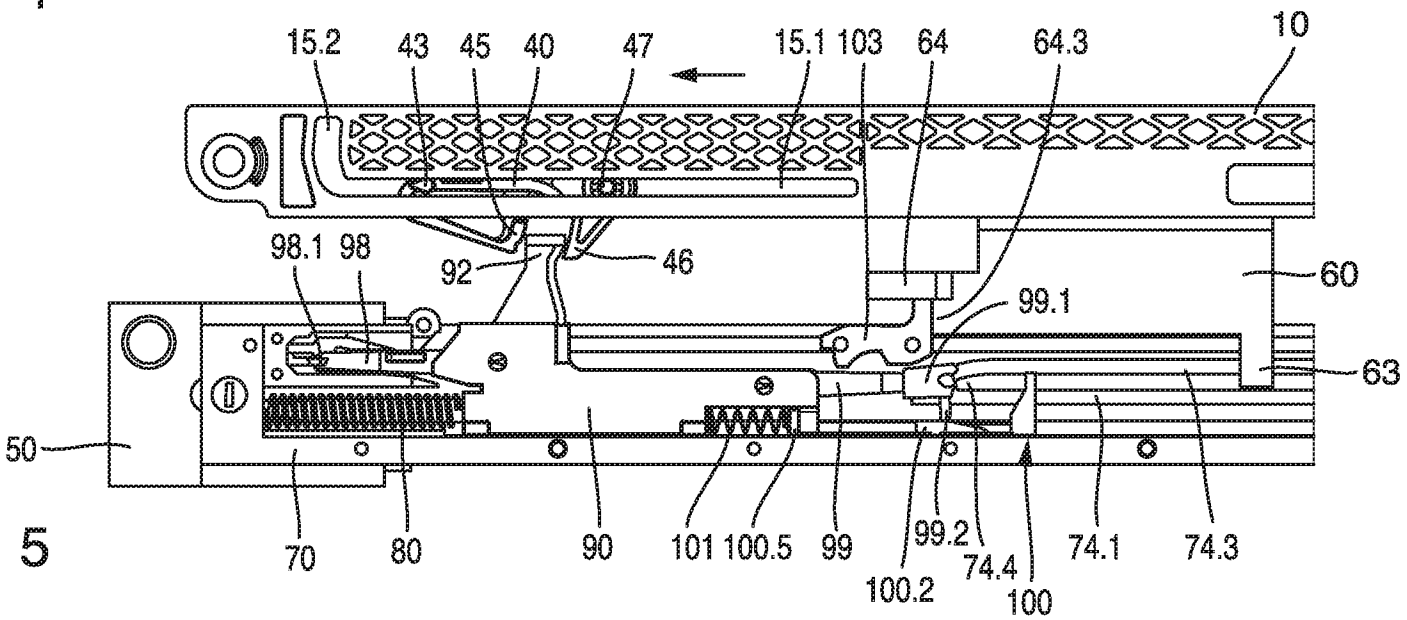

As a result of the relative movement that is now possible between coupling piece 92 and pull-in apparatus 10, coupling piece 40 is moved out of its parked position. In that context, coupling element 40 is moved, around the pivot axis constituted by guide parts 47, out of its tipped-over position. As a result of this pivoting movement, guide elements 43 move out of locking portions 15.2 and come into guide portions 15.1 of guide 15. Because coupling element 40 is now no longer immobilized, spring 20 can relax. Coupling element 40 is thereby shifted to the right in the image plane as shown in FIGS. 4 and 5. At the same time, damping apparatus 30 acts against the pulling-in force of the spring and damps the displacement of coupling element 40. As a result, the drawer is pulled into the closed position and simultaneously damped, as further depicted by the arrows in FIGS. 4 and 5.

Figure 6:
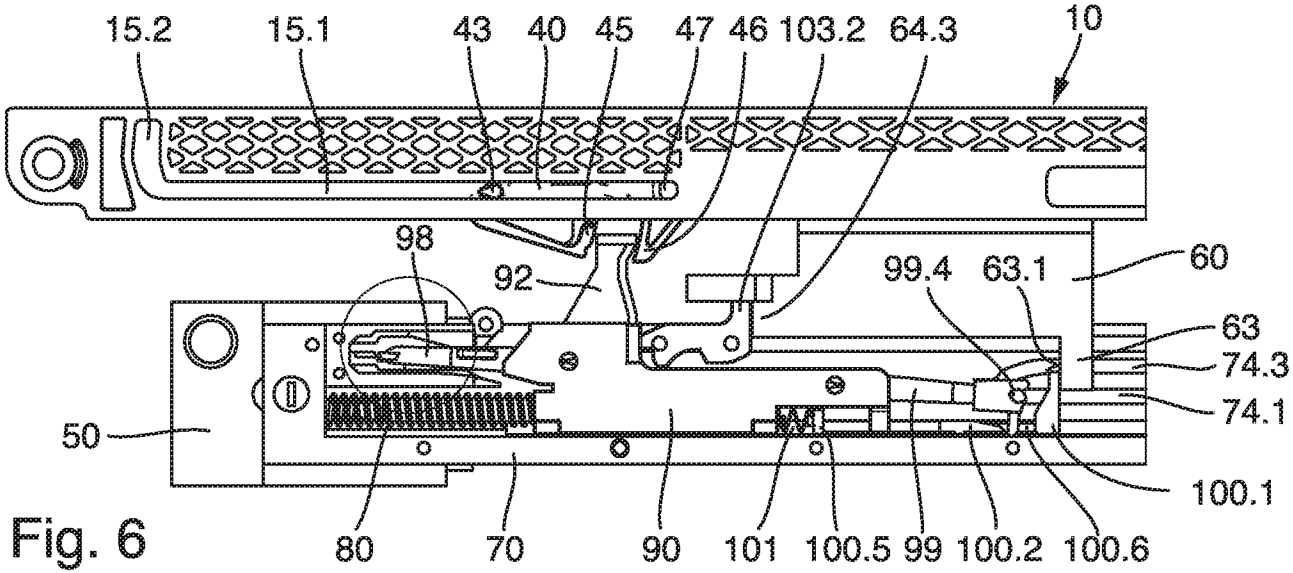

FIG. 6 shows the position in which the drawer is completely closed. As is evident from this Figure, and as shown enlarged in FIG. 7, first switching piece 98 has traveled into switching module 71. Guide extension 98.1 is being pressed by spring 80 into the undercut holding portion 71.6. Guide element 90 is thereby held nondisplaceably, in the longitudinal extent of groove 76, in the direction of the tensioning force of energy reservoir 80. This can be referred to as a parked position of the guide element 90. When the drawer is in the closed position, energy reservoir 80 is charged. Spring 20 is relaxed, and damping apparatus 30 is in the pushed-in damper position. As further shown in FIG. 6, during the transition from FIG. 5 to FIG. 6 stop 63.1 strikes against countermember 100.1 of immobilizing part 100. Follower 60 thereby pushes immobilizing part 100 from right to left in the image plane of FIG. 6, against the preload of spring 101. Immobilizing part 100 is therefore correspondingly displaced with respect to guide element 90. Second switching piece 99 is then also released by the fact that delimiting element 99.2 comes into the region of setback 100.6 of immobilizing part 100. Second switching piece 99 can then thereby rotate farther clockwise. As a result, guide elements 99.4 come into the region of return guide 74.1 of guide 74, and guide extension 98.1 of first switching piece 98 into holding portion 71.6 of switching module 71. This is also apparent from FIG. 5.

Figure 8:
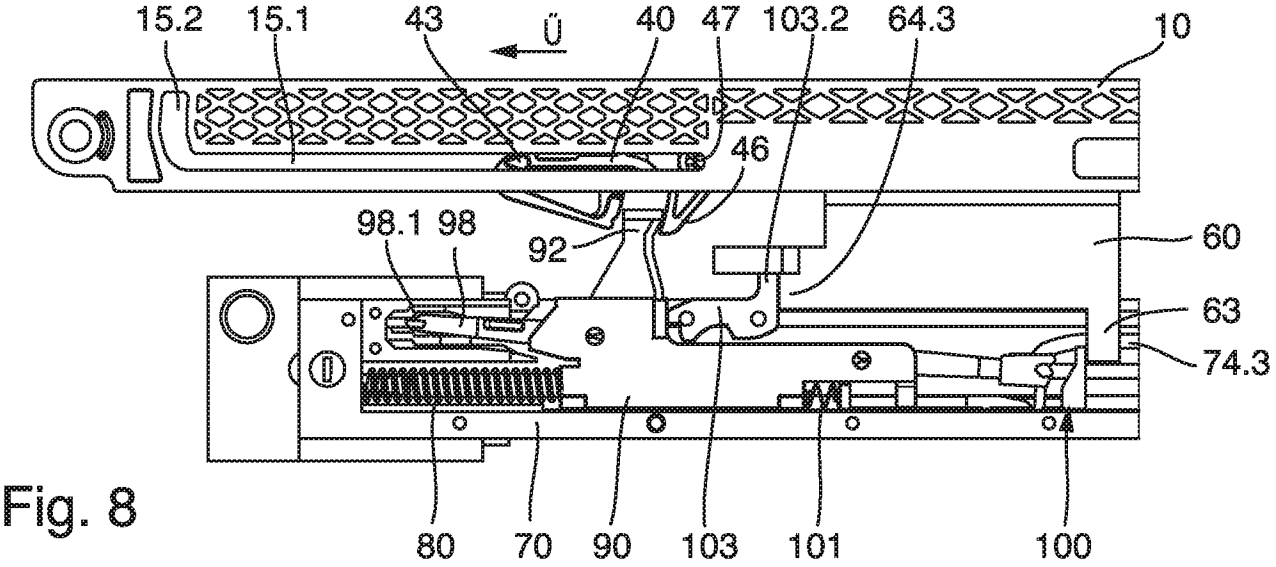
Figure 7:
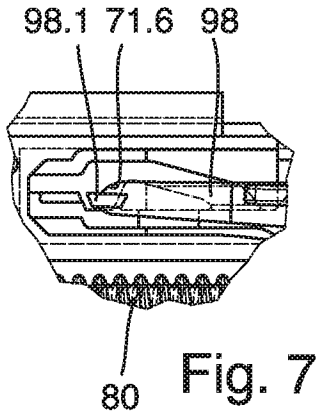

FIG. 8 now shows the procedure upon opening of the drawer that is in the closed position as shown in FIG. 6. If an overtravel (arrows labeled "U") is applied onto the drawer as shown in FIG. 8, pull-in apparatus 10 becomes shifted a short distance from right to left. In the context of this pushing movement, a force is transferred from stop 46 of coupling element 40 onto coupling piece 92, as shown in FIG. 8. This force is transferred to energy reservoir 80, so that as energy reservoir 80 is compressed, guide element 90 is likewise displaced a little way to the left. The movement is also transferred to second switching piece 98. The result of this movement is that guide extension 98.1 travels over step 71.5 of switching module 71 and then arrives on surface portion 71.7 located lower down. In that context, first switching piece 98 becomes rotated clockwise and guide extension 98.1 comes out of engagement with holding portion 71.6. The locking of first switching piece 98 is thereby canceled, and a very short switching travel can be achieved. This has the advantage that the switching operation can be initiated by even a short triggering travel applied to the drawer front.

Figure 9:
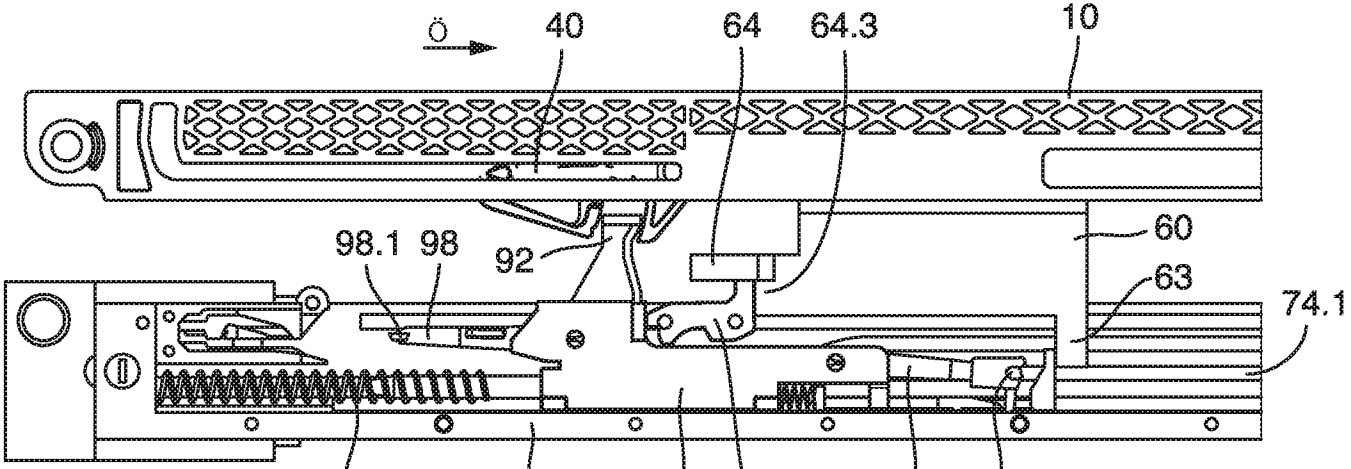
Figure 10:
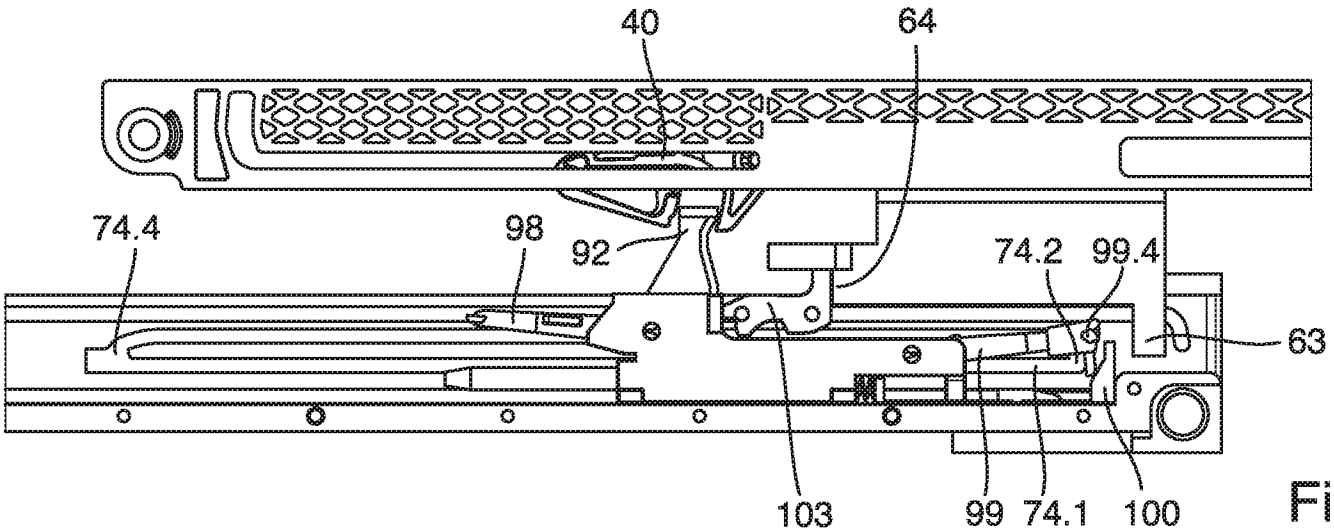
Figure 11:
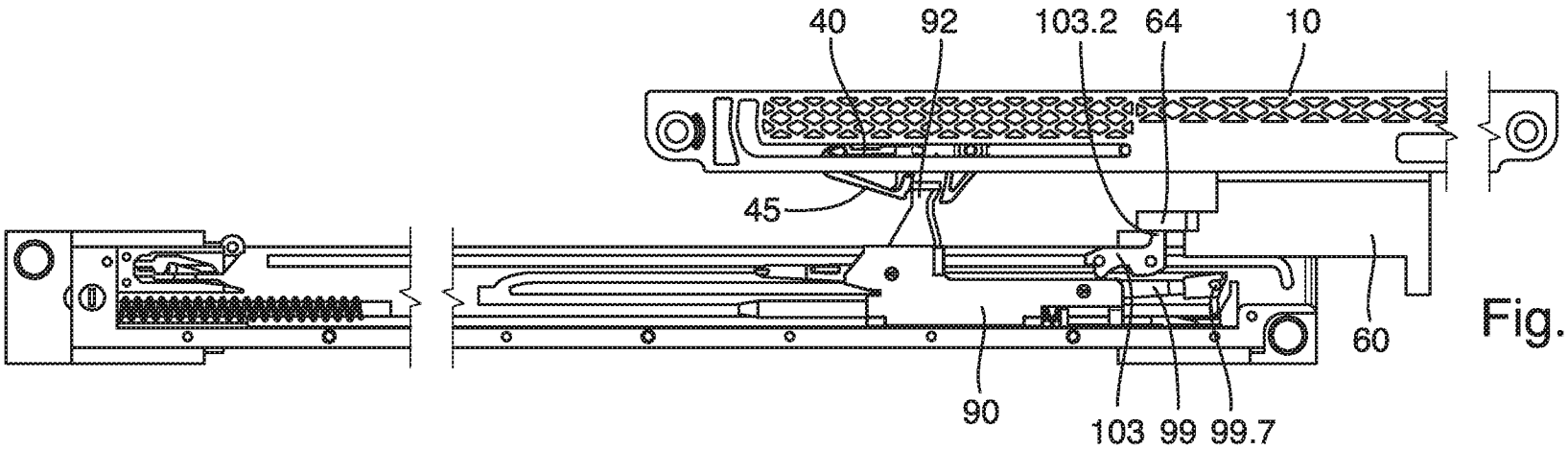

When the drawer is released, energy reservoir 80 can then discharge, as shown in FIG. 9. As symbolized by the arrows depicted, the drawer is moved in an opening direction "0". In specific, the force of energy reservoir 80 is transferred to guide element 90, and from coupling piece 92 to coupling element 40. In the course of the opening movement, second switching piece 99 slides with its guide elements 99.4 along return guide 74.1. The pushing-out movement into a partly open position occurs until the position shown in FIG. 10 is reached. The position of FIG. 10 can be referred to as an ejection position of the guide element 90. The energy reservoir 80 can be described as being configured to displace the guide element 90 from the parked position of FIG. 6 to the ejection position of FIG. 10. In that context, second switching piece 99 at the end of return guide 74.1 is moved, with its guide elements 99.4, into the region of transition portions 74.2 and is immobilized there. Transition portion 74.2 is configured in such a way that the second switching element, with its guide elements 99.4, becomes rotated counter-clockwise. The partly opened drawer can be conveniently grasped in order to be completely opened. When the drawer is then pulled out manually, coupling element 40 is then displaced from right to left, as shown in FIG. 11, spring 20 being tensioned and damping apparatus 30 being pulled out. The force transfer between coupling element 40 and the furniture carcass is accomplished ultimately via coupling piece 92, which abuts against stop 45 of coupling element 40.

Figure 12:
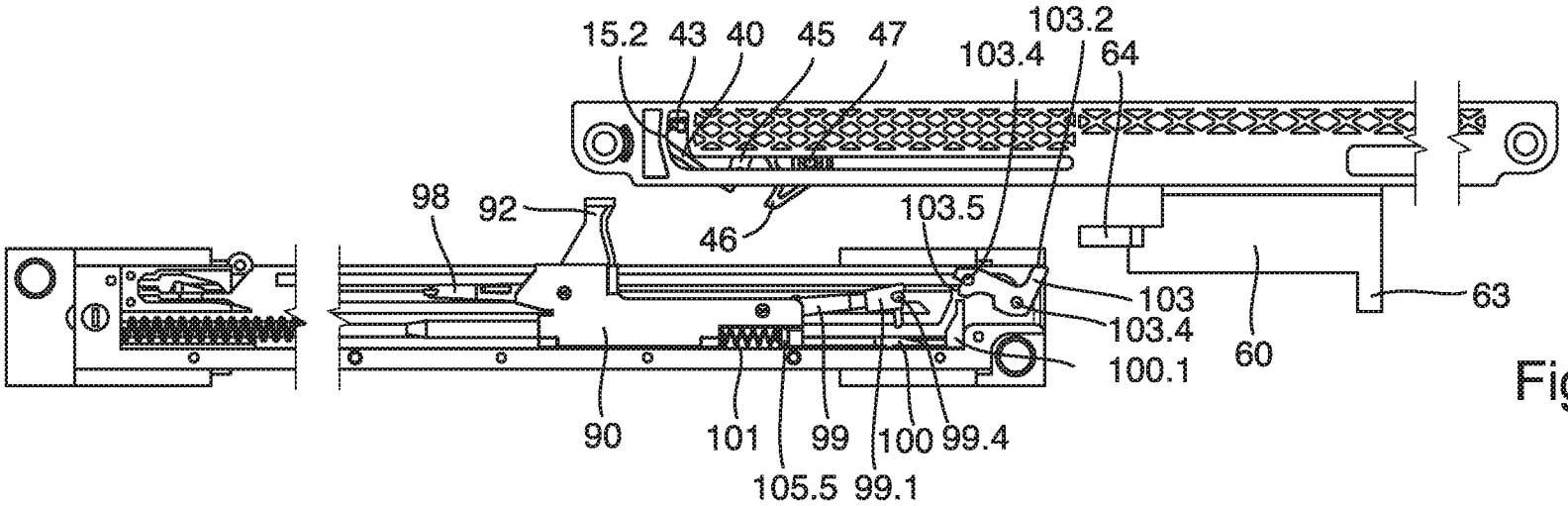

Extension 64 is used so that slider 103 can be moved back into its parked position during the opening movement of the drawer. Said extension engages behind switching extension 103.2 of slider 103 and pulls it, together with pull-in apparatus 10, from left to right in the image plane of FIG. 11. The drawer must be pulled, by application of force, until guide elements 43 of coupling element 40 come into the region of locking portion 15.2 of guide 15. Coupling element 40 then tips over into its parked position, as shown in FIG. 12. As a result of the clockwise pivoting movement of coupling element 40, stop 45 also tips over, and coupling piece 92 held between the two stops 45 and 46 becomes released. Simultaneously, or also with a time offset relative thereto, slider 103 comes into its tipped-over position shown in FIG. 12. Switching extension 103.2 comes out of engagement with extension 64 of follower 60.

Spring 101 can now relax, and pushes immobilizing part 100 into its position shown in FIG. 12, in which context support part 100.5 comes to a stop against a projection of guide element 90. Because countermember 100.1 is now also once again bracing against a body edge of housing part 70, guide element 90 becomes shifted a little way to the left out of its rightward position shown in FIG. 11. This ensures that guide elements 99.4 end up again in the region of longitudinal guides 73.2. The push-out assemblage is then once again prepared, as shown in FIG. 2, for the drawer to be reclosed.

FIGS. 13 to 16 show a further exemplifying embodiment of the invention. This second exemplifying embodiment corresponds substantially to the exemplifying embodiment according to FIGS. 1 to 12, and identical reference characters are therefore used for identical components. To avoid repetition, reference is therefore made to the statements above regarding the exemplifying embodiment according to FIGS. 1 to 12. Pull-in apparatuses 10, in particular, are identical. Housing 70 is identical, although guide 73 can be omitted in the second exemplifying embodiment. In addition, in the exemplifying embodiment according to FIGS. 13 to 16 coupling piece 92 can be connected as one piece to housing 70. Coupling piece 92 can also, however, be installed on the fitting onto which housing 70 is also fastened. The outlay in terms of parts and installation is less, however, when coupling part 92 is associated as shown in the drawings. Switching module 71 is also identical, as are switching pieces 98 and 99. Guide elements 90 also largely correspond to one another; in guide element 90 according to FIGS. 13 to 16, pin 93 is longer and can penetrate through an opening 70.1 in housing 70. In addition, no coupling piece 92 is present on guide element 90 (it is now mounted on the housing side; see statements above). Immobilizing part 100 and its manner of operation, in particular in conjunction with guide element 90 and switching piece 99, are identical.

Figure 13:
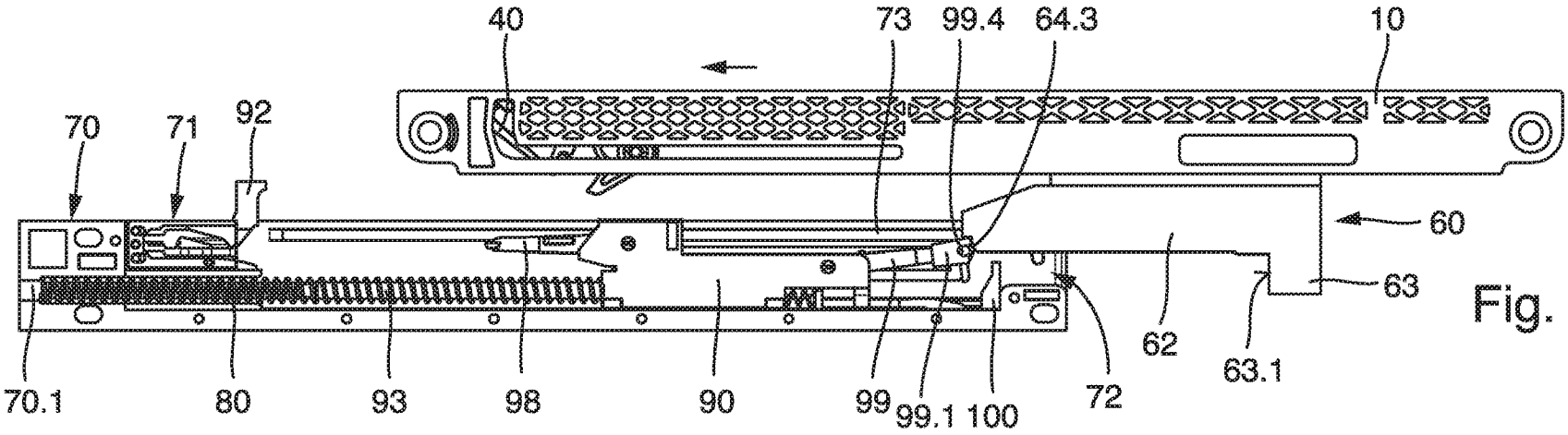
FIGS. 13 to 16 are side views showing a second variant embodiment of a movement assemblage in various switched positions.

As is evident from FIG. 13, a follower 60 is once again used. Follower 60 is modified in terms of its design as compared with follower 60 in accordance with FIGS. 1 to 12. It can be selected, however—physically in terms of its association with the furniture part or functionally with respect to pull-in apparatus 10—in the manner described above. Follower 60 once again comprises a connecting piece 61 and a spacer 62. It also has an actuation piece 63 having a stop 63.1 and a stop 64. Now, however, stop 64 acts not on a slider 103 but instead directly on head 99.1 of switching piece 99. Actuation piece 63 continues to interact, with its stop 63.1, with immobilizing part 100, as described above.

When follower 60 then strikes head 99.1 with stop 64.3 as the drawer is closed, as depicted in FIG. 13, guide element 90 is then shifted, by means of follower 60 and switching piece 99, to the left in the image plane of FIG. 13 against the preload of spring 80. Spring 80 is embodied to be considerably longer than spring 80 in accordance with the first exemplifying embodiment. Preferably, as depicted in the drawings, spring 80 is sufficiently long that in the basic position as shown in FIG. 13 it is retained at its ends against housing 70 on the one hand and against guide element 90 on the other hand. When guide element 90 is displaced, that therefore occurs against the preload of spring 80. When head 99.1, along with its guide element 99.4, has been shifted in longitudinal guides 73.2 and comes into the region of transition portion 74.4, switching piece 99 becomes rotated a little farther clockwise. The coupling to stop 64.3 is thereby canceled.

Pull-in apparatus 10 now, with its spring 20, pulls the drawer toward the closed position. First switching piece 98 is now, with its guide extension 98.1, in overtravel in switching module 71 until stop 63.1 releases second switching piece 99 by pushing immobilizing part 100 forward. Energy reservoir 80 now pushes guide extension 98.1 of first switching piece 98 onto holding portion 71.6. In the overtravel position, slider 103 90 cannot be unlocked by external application of force to the drawer because it is immobilized in that position. It is therefore, in particular, prevented from inadvertently initiating an ejection operation.

Figure 14:
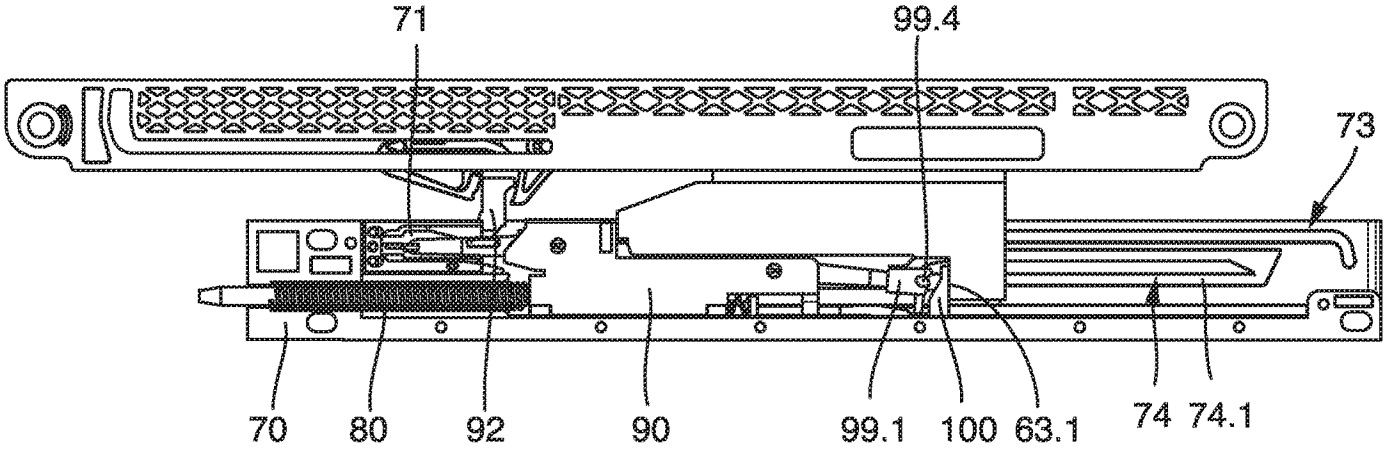

When switching piece 98 is latched in switching module 71, guide element 90 is held on housing 70 as shown in FIG. 14. Simultaneously or thereafter, coupling piece 92 strikes follower 60 of the pull-in apparatus. Thanks to the spring action of spring 20 of pull-in apparatus 10, the drawer becomes pulled into the closed position against the action of damping apparatus 30. FIG. 14 shows the closed position. As is evident from this illustration, immobilizing part 100, actuated by the arrival of stop 63.1, releases head 99.1. As a result, guide element 99.4 comes into the region of return guide 74.1.

Figure 15:
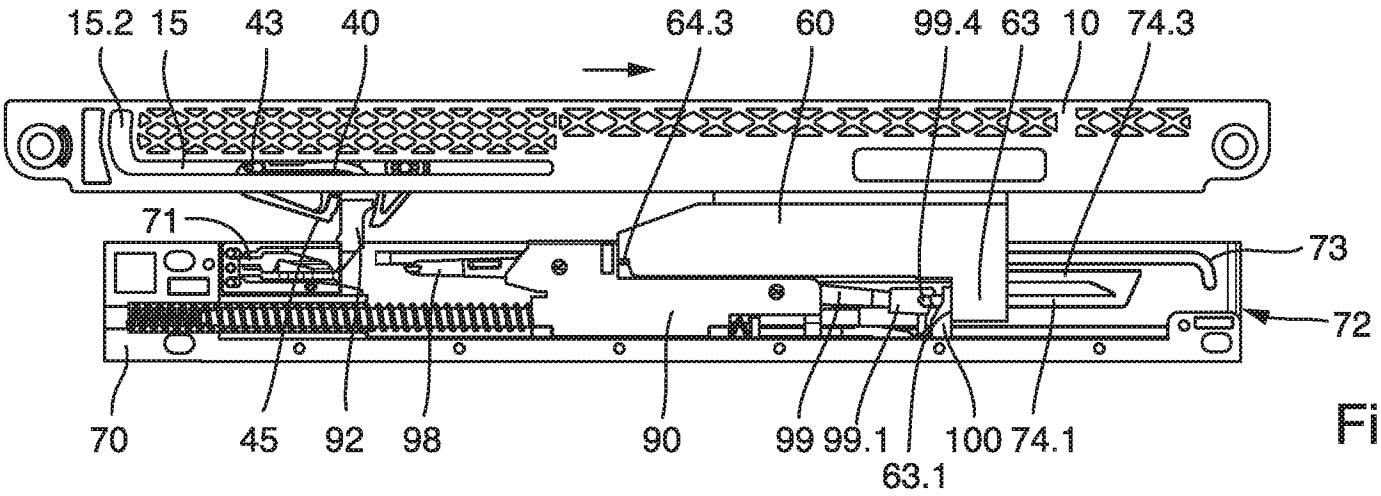
Figure 16:
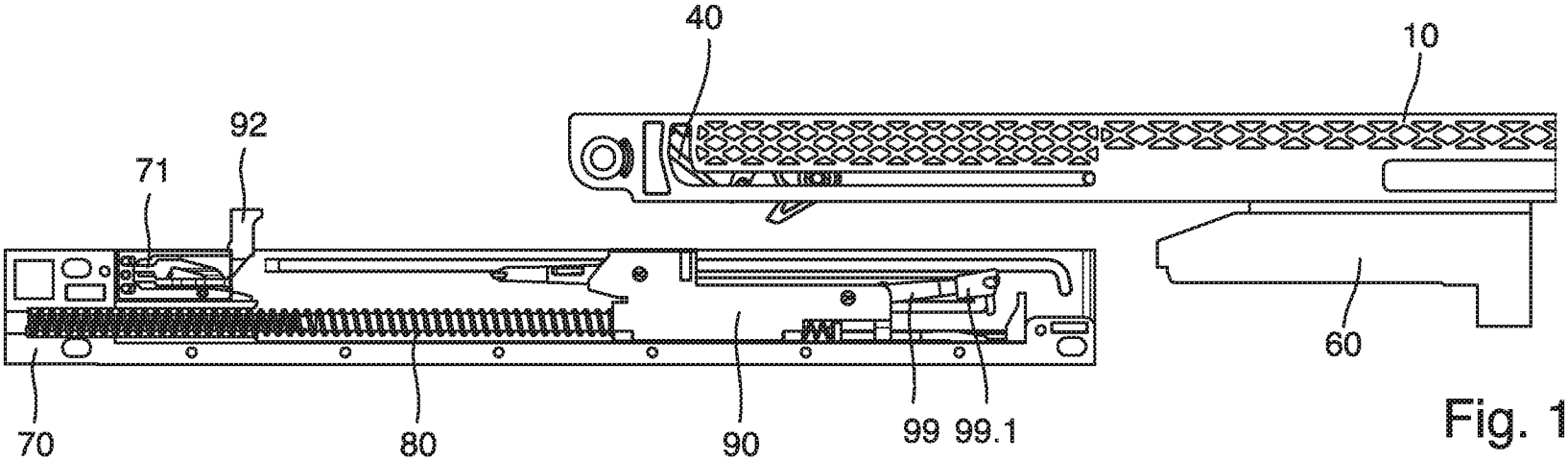

When an overtravel is then applied to the drawer while it is closed, switching module 71 then switches as described above. Spring 80 can now discharge its energy. The force of spring 80 is greater than the force of spring 20 of pull-in apparatus 10. As spring 80 relaxes, spring 20 therefore becomes loaded, and damping apparatus 30 becomes pulled out, via coupling piece 92 and coupling element 40. FIG. 15 shows a position upon transition of the drawer from the closed position into the open position, and in a region of the travel in which spring 20 becomes loaded. As is evident from this illustration, coupling element 40 becomes shifted in guide 15 of housing 10. As soon as coupling element 40 arrives, with its guide element 43, in the region of locking portion 15.2, coupling element 40 of guide 15 becomes tipped back over clockwise. Stop 45 releases coupling piece 92. This position is shown in FIG. 16. The kinetic energy applied by spring 80 is sufficient that the drawer is now automatically displaced farther in the opening direction.

The design shown in FIGS. 13 to 16 is suitable in particular for drawers in which an extremely accurate association between pull-in apparatus 10 and switching piece 99 can be achieved. In particular with modern pull-in guides, this is the case when the subassemblies are installed directly onto the pull-in guides.

FIGS. 17 to 29 depict a further exemplifying embodiment of the invention. To avoid repetition, components that are identical in this exemplifying embodiment are labeled with identical reference characters. The statements above can accordingly be referred to. The explanations provided above regarding the first two exemplifying embodiments also apply to this third exemplifying embodiment. The discussion below will therefore concentrate on the differences of the third exemplifying embodiment.

As is evident from FIG. 17, once again a pull-in apparatus 10 is used which is identical in design to pull-in apparatus 10 described above. A follower 60 that comprises a connecting piece 61 is once again used. Said piece can be plate-shaped, as depicted in the present case. A spacer 62 is shaped onto connecting piece 61. Spacer 62 carries an actuation piece 63. Actuation piece 63 comprises a stop 63.1.

Pull-in apparatus 10 can be coupled to follower 60. For that purpose, the pull-in apparatus is placed with its rear (in FIG. 17) side onto the front side of the plate-shaped connecting portion 61. Orifices of connecting portion 61 then line up with orifices of fastening pieces 13 of pull-in apparatus 10. The connection can be made using suitable coupling elements, for example screws.

Figure 17:
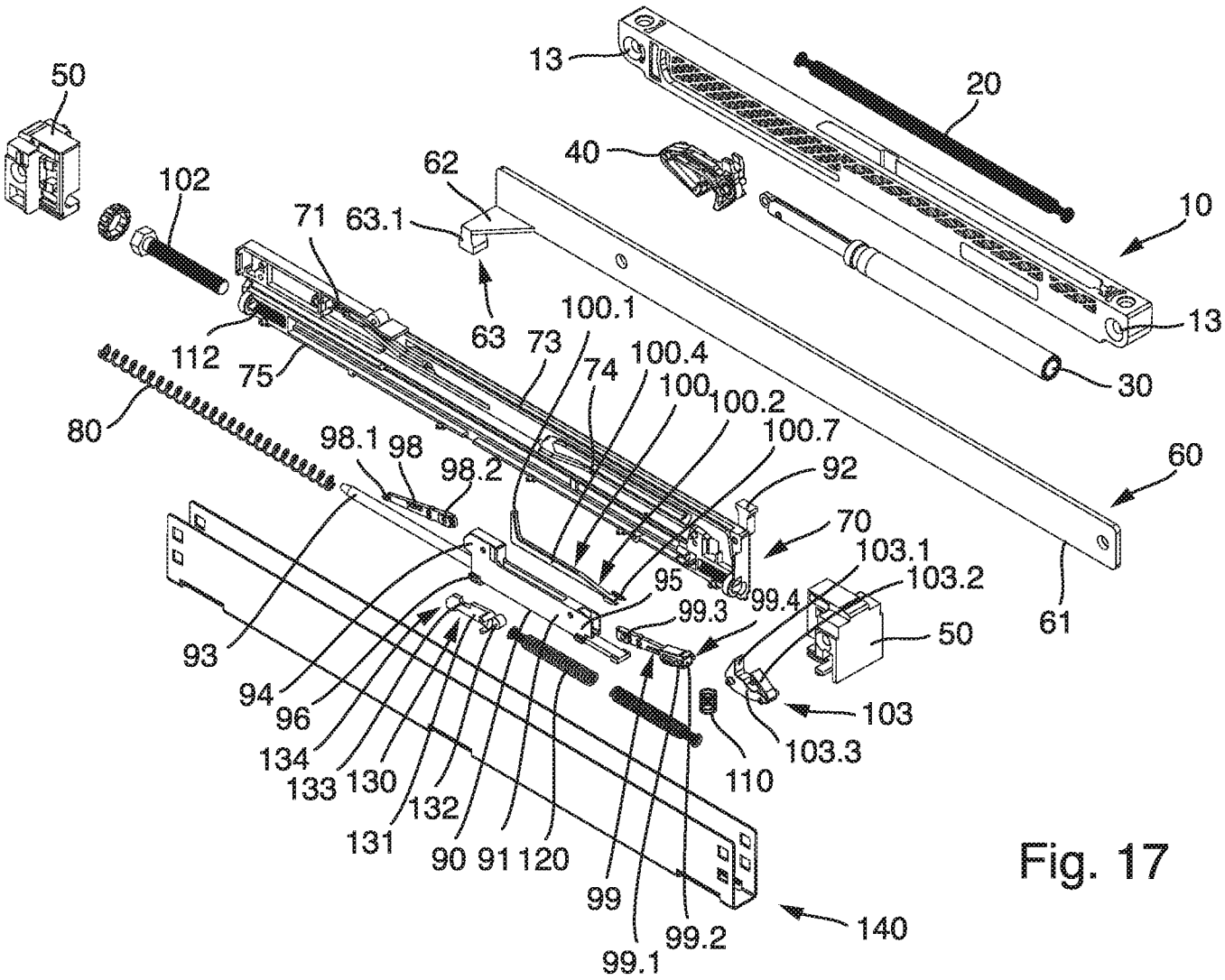
FIGS. 17 to 27 are various views of a third variant embodiment of a movement assemblage.

The push-out assemblage once again comprises a housing 70 that is assembled from two housing parts 71. For better clarity, only one housing part 71 is depicted in FIG. 17. It is conceivable, as depicted in FIG. 17, for the two housing parts 70 in the assembled state to be inserted into a holder 140 produced, as a stamped bent part, from a cut piece of sheet metal. Holder 140 is embodied to be U-shaped in cross section. It comprises two mutually parallel limbs that are connected to one another via a connecting portion. In the installed state, each housing part 70 abuts against the inner side of one limb of holder 41.

As is evident from FIG. 17, a switching module 71 is again integrated into housing part 70. Switching module 71 is identical in design to switching module 71 described above. The corresponding statements may therefore be referred to.

A coupling piece 92 is fastened onto housing part 71 or housing 70. In the present case, coupling piece 72 is shaped on as one piece.

Housing part 70 comprises, once again in physically identical fashion, a guide 73 and a guide track 74.

An energy reservoir 80 is accommodated in a spring receptacle 75. Energy reservoir 80 is again embodied in the form of a compression spring that is slid onto pin 93 of a guide element 90.

As stated with reference to the first exemplifying embodiment described above, guide element 90 possesses a base body 91. Guide element 90 comprises holders 94, 95 for the first and second switching pieces 98, 99. The two switching pieces 98, 99 are once again fastened pivotably onto base body 91 using bearings 98.2, 99.3. The two switching pieces 98, 99 once again each comprise at least one guide extension 98.1 or at least one guide element 99.4 which is embodied to be guided in the preferably groove-shaped guides 73, 74.

Immobilizing part 100 that is used in the second exemplifying embodiment differs from immobilizing part 100 in accordance with the first exemplifying embodiment. In the second exemplifying embodiment, immobilizing part 100 is embodied as a slider. It is held, with guide extension 104, longitudinally displaceably on or in guide element 90. It can correspondingly be shifted from left to right and from right to left in the image plane of FIG. 18.

Figure 18:
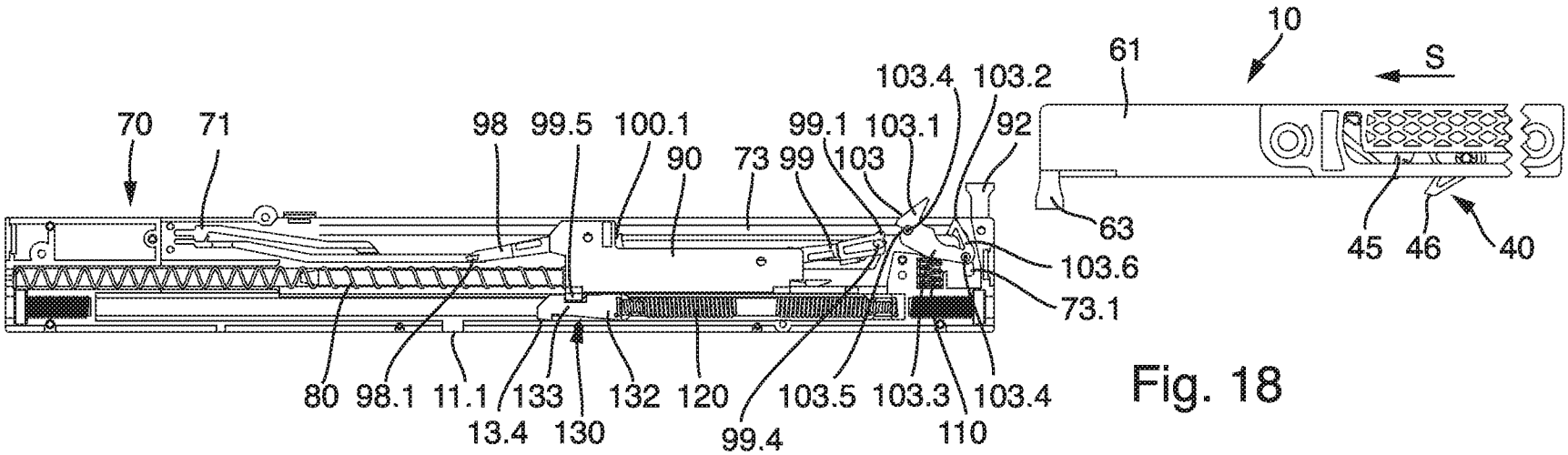
Figure 19:
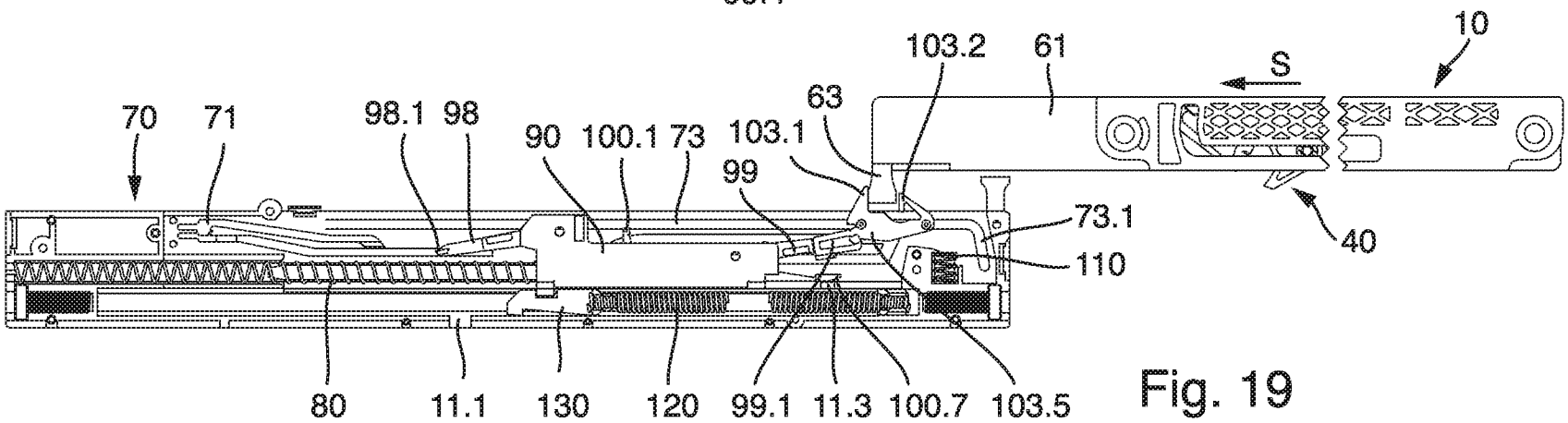

Immobilizing part 100 comprises a countermember 100.1 that projects beyond a body region of guide element 90, as is evident from FIGS. 18 and 19. As shown in FIG. 17, immobilizing part 100 comprises a receptacle 100.2 that is preferably embodied as an oblique surface.

A counterpart stop 100.7 is fastened, preferably as one piece, in the region of the free end of receptacle 100.2.

As FIG. 17 shows, the push-out assemblage also encompasses a slider 103. Slider 103 possesses two switching extensions 103.1, 103.2 that are arranged with a spacing from one another in an ejection direction. A receptacle for actuation piece 63 is correspondingly produced between the two switching extensions 103.1, 103.2.

Slider 103 comprises a guide holder 103.3. Guide pieces 103.4 are provided on both sides of guide holder 103.3. These guide pieces 103.4 engage into guide tracks 73 of housing parts 71. As has already been described, provision can also be made that slider 103 is guided, with only one or with several guide pieces 103.4, in only one guide 73 of a housing part 70.

In a manner that is identical in design to the embodiment described above, slider 103 possesses a stop 103.5 (see FIG. 18). As is further evident from FIG. 17, switching extension 103.2 is coupled via a spring element 103.6 onto guide holder 103.3. As shown in FIG. 19, switching element 103.2 can be deflected, with spring element 103.6, from top to bottom in the image plane. In the deflected state it exposes the receptacle between switching extensions 103.1, 103.2, so that actuation piece 63 can travel into that receptacle when slider 103 is in the position shown in FIG. 19 but actuation piece 63 is outside the receptacle. Incorrect installation can thereby be compensated for without damage.

Figure 28:
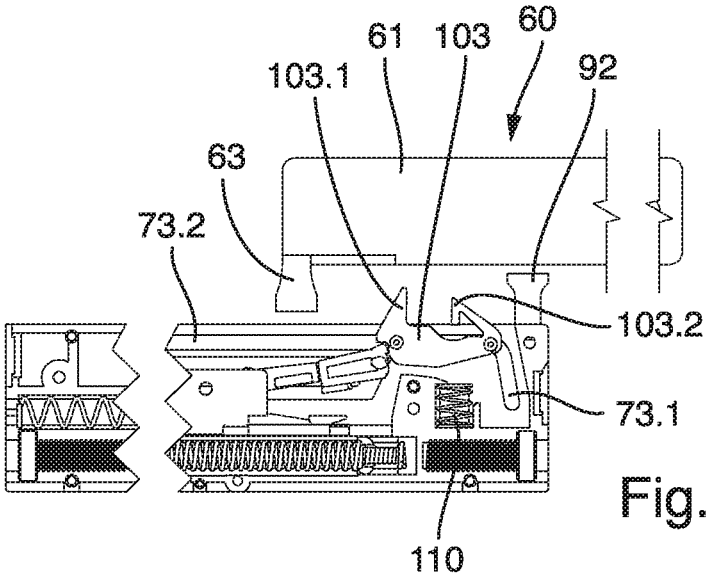
FIG. 28 is a side view of a fourth variant embodiment of a movement assemblage with the slider in a parked position.
Figure 29:
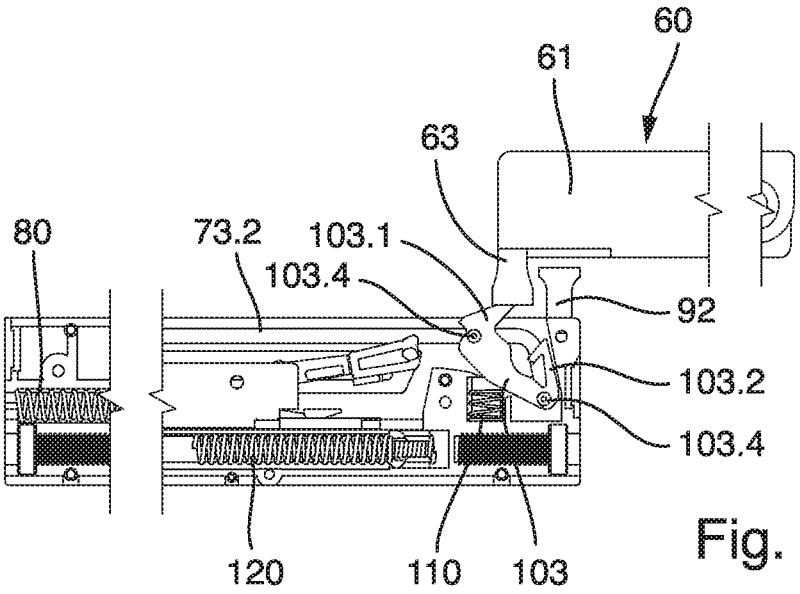
FIG. 29 is a view similar to FIG. 28 showing the slider of FIG. 28 not in a parked position.

As is further evident from FIGS. 17 and 18, a spring element 110 is arranged in the transition region between parking portion 73.1 and longitudinal guide 73.2 of guide 73. The function of this spring element 110 will be referred to later when FIGS. 28 and 29 are discussed.

As illustrated by the drawings, a secondary spring 120 can be used in the exemplifying embodiment that is shown. Utilization without secondary spring 120 is also conceivable. Secondary spring 120 is embodied as a tension spring, but with suitable positioning it can also be embodied as a compression spring or as another suitable energy reservoir. Secondary spring 120 is secured to the housing at its one end, that being the right end of secondary spring 120 in FIG. 18. The opposite end of secondary spring 120 is fastened onto a coupling member 130. Coupling member 130 is mounted longitudinally displaceably in the housing, preferably in housing part 70. Coupling member 130 has a spring holder 131 for coupling to secondary spring 120. In the present exemplifying embodiment, the coupling of secondary spring 120 is selected so that a torque can be introduced into coupling member 130. The torque acts counter-clockwise in the drawing plane, so that an extension 134 of coupling member 130 becomes pushed downward, i.e. away from guide element 90. Coupling member 130 comprises a base piece 132 that is equipped with a receptacle 133. As shown by the illustration according to FIG. 18, extension 134 can be arranged oppositely from receptacle 133.

FIG. 17 shows that, similarly to the case with the exemplifying embodiment in accordance with FIGS. 1 to 16, holder 50 can be utilized in order to attach the push-out assemblage optionally either to a movable furniture part or to a fixed furniture part (for example, a drawer or a furniture carcass). The detailed configuration of holder 50 is selected differently from what has been described above, but the functionality is the same. Once again, a positioning member 102 that can be embodied, for example, as a screw is used to adjust the gap spacing between the drawer and the furniture carcass. Positioning member 102 can be threaded, with an external thread, into a threaded receptacle 11.2 of housing 70. Positioning member 102 braces against the associated holder 50, so that the push-out assemblage can be displaced in the threading direction relative to holder 50 in order to adjust the gap spacing.

The manner of operation will be discussed in further detail below, reference being made firstly to FIG. 18. FIG. 18 shows the open position of the movable furniture part (for simplification, the drawer will be designated hereinafter as the movable furniture part). With the drawer in the open position, pull-in apparatus 10 is not in functional contact with the push-out assemblage. As has been described above, spring 20 is tensioned, coupling element 40 is in its tipped-over position, and damping apparatus 30 is pulled out. Actuation piece 63 of follower 60 faces toward slider 103 in closing direction S. When the drawer is then closed, actuation piece 63 strikes against switching extension 103.1 of slider 103. Slider 103 is at first in its released position, front guide pieces 103.4 being received in parking portions 73.1. Rear guide pieces 103.4 are received in longitudinal guide 73.2. Because of the tipped position of slider 103, switching extension 103.2 is positioned so that actuation piece 63 can travel without impediment into the receptacle between switching extensions 103.1, 103.2. Actuation piece 63 then, because of its camming action on slider 103, lifts slider 103 out of its tipped-over position in FIG. 18. The pivoting movement proceeds around the pivot axis constituted by rear guide pieces 103.4. Slider 103 is moved out of its parked position so that guide pieces 103.4 come into the region of longitudinal guide 73.2. Slider 103 then strikes with its stop 103.5, in the manner also described above, against second switching piece 99, in which context stop 103.5 engages against head 99.1 of second switching piece 99. The drawer can now be pushed against the force of energy reservoir 80. At the same time, the drawer can also be pushed against the force of secondary spring 120. This secondary spring 120 is coupled via coupling member 130 to guide element 90. Guide element 90 has for that purpose an extension 99.5 that engages into receptacle 133 of coupling member 130. Guide element 90 therefore entrains coupling member 130, and with it secondary spring 120 that is coupled onto coupling member 130. In the context of the displacement of guide element 90, second switching piece 99 slides with its guide element 99.4 in longitudinal guide 73.2 of guide 73. First switching piece 98 moves toward switching module 71.

Figure 20:
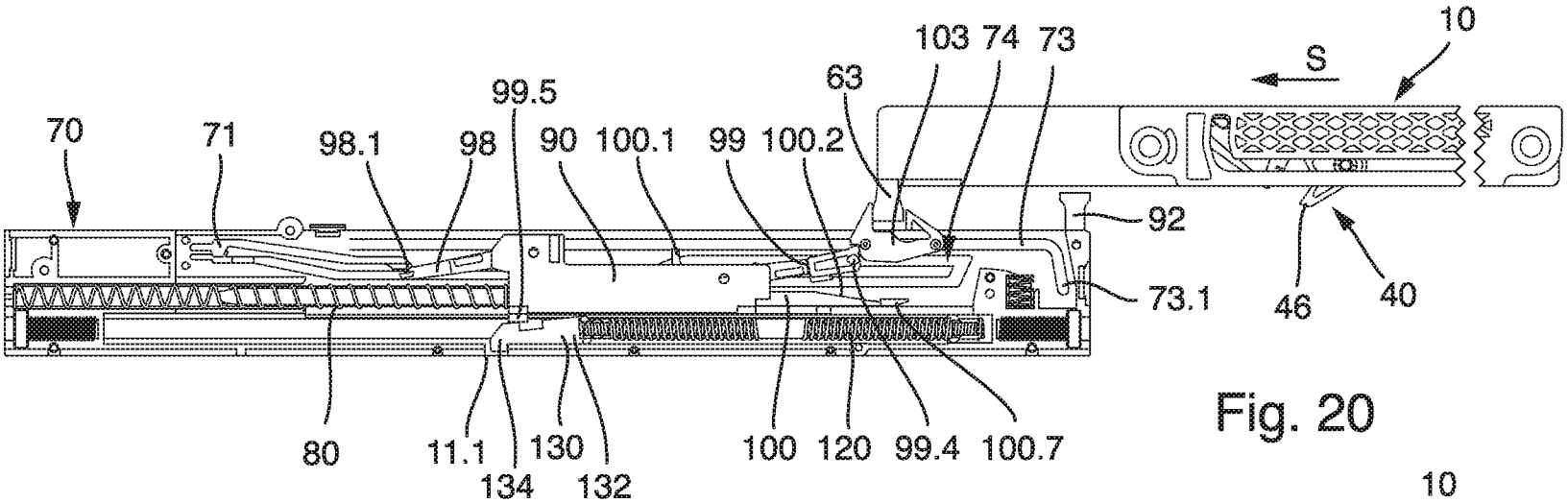
Figure 21:
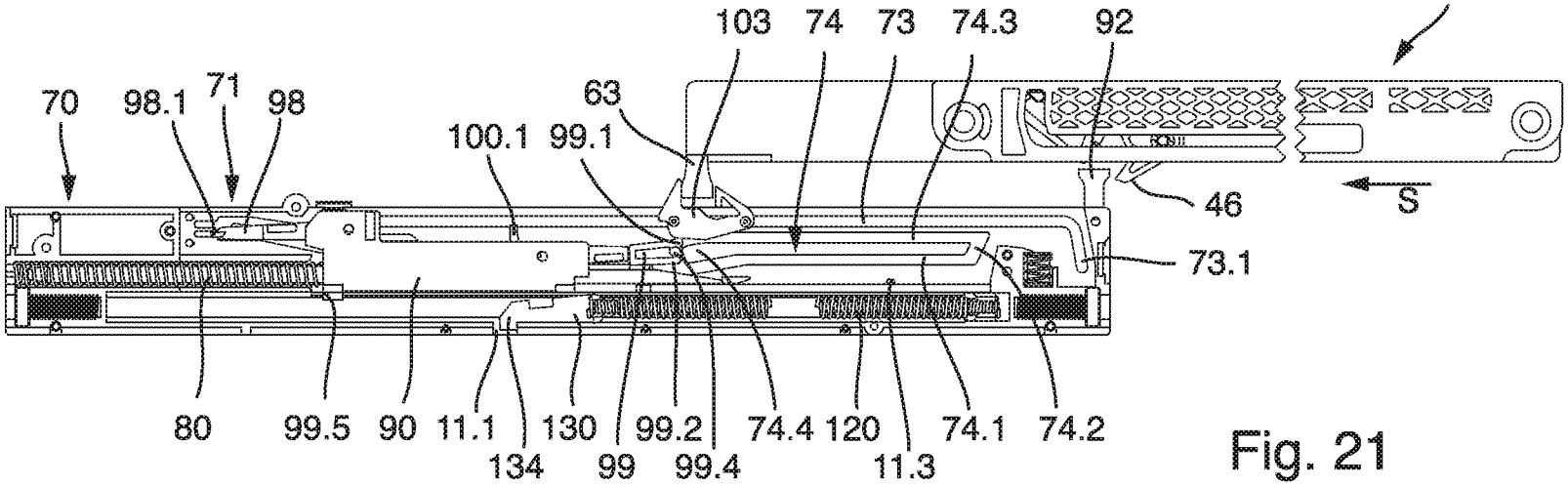

The closing movement continues as shown in FIGS. 20 and 21. Secondary spring 120 becomes set aside in the course of the closing movement, as shown by FIG. 20. The housing has a receptacle 11.1 for that purpose. Because of the above-described torque that acts counter-clockwise, coupling member 130 tips over when extension 134 is located opposite receptacle 11.1. The set-aside position is shown in FIG. 21. Guide element 90 can now be pushed further, uninfluenced by secondary spring 120 and against the force of energy reservoir 80. In this context, second switching piece 99 slides along guide region 74.3 of guide track 74 until it comes into transition region 74.4. All this has already been described above in further detail. In transition region 74.4, the second switching piece pivots clockwise and the connection between switching piece 99 and slider 103 is canceled. Slider 103 can therefore now be displaced relative to second switching piece 99 and can move past it. It is evident from FIG. 21 that first switching piece 98 has traveled into switching module 71. A depiction of the functionality and interaction of switching module 71 with first switching piece 98 is omitted here, since the corresponding explanations have already been provided here with reference to the first two exemplifying embodiments.

As is evident from FIG. 21, second switching piece 99 travels with its guide element 99.4 onto an oblique surface in transition portion 74.2. This oblique surface is embodied to be inclined with respect to the pressure direction of energy reservoir 80, as is evident from FIG. 21. In the present exemplifying embodiment, it proceeds obliquely from top to bottom. When slider 103 passes second switching piece 99, guide element 90 becomes released. First switching piece 98 is in overtravel. Energy reservoir 80 pushes guide element 90 a little farther oppositely to closing direction S. As a result, first switching piece 98 in switching module 71 becomes pushed a little way toward its locking position in switching module 71. Ejection spring 80 pushes second switching piece 99 along the above-described inclined surface of transition region 74.4, toward return guide 74.1 of guide track 74. This movement occurs in FIG. 21 over only a short distance, since second switching piece 99 becomes immobilized, with its delimiting element 99.2, against receptacle 100.2 of immobilizing part 100. The position shown in FIG. 21 is thus produced.

It is also evident from FIG. 21 that once slider 103 has passed second switching part 99, coupling piece 92 strikes stop 46 of coupling element 40 of pull-in apparatus 10. Because of the camming action of coupling piece 92 on coupling element 40, coupling element 40 becomes lifted out of the tipped-over position shown in FIG. 21. Coupling element 40 then comes into the region of guide portion 15.1 of pull-in apparatus 10. As already described above with reference to the first two exemplifying embodiments, spring 20 now pulls coupling element 40 against the damping force of damping apparatus 30. By way of the coupling to the push-out assemblage, the drawer is pulled in a closing direction until it reaches the closed position C shown in FIG. 23.

Figure 22:
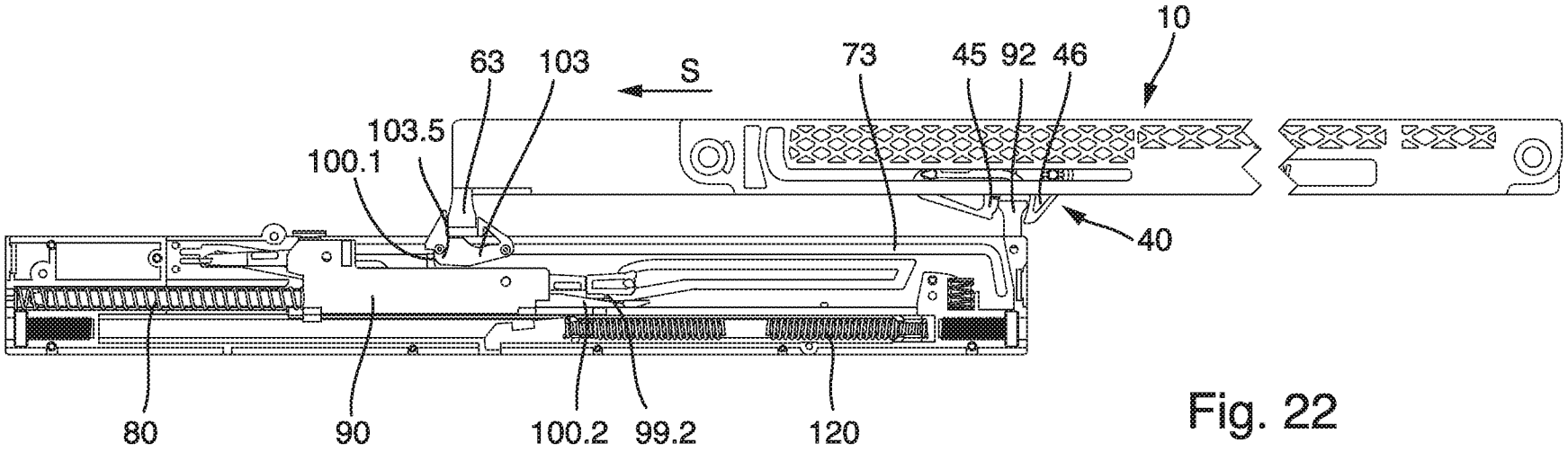
Figure 23:
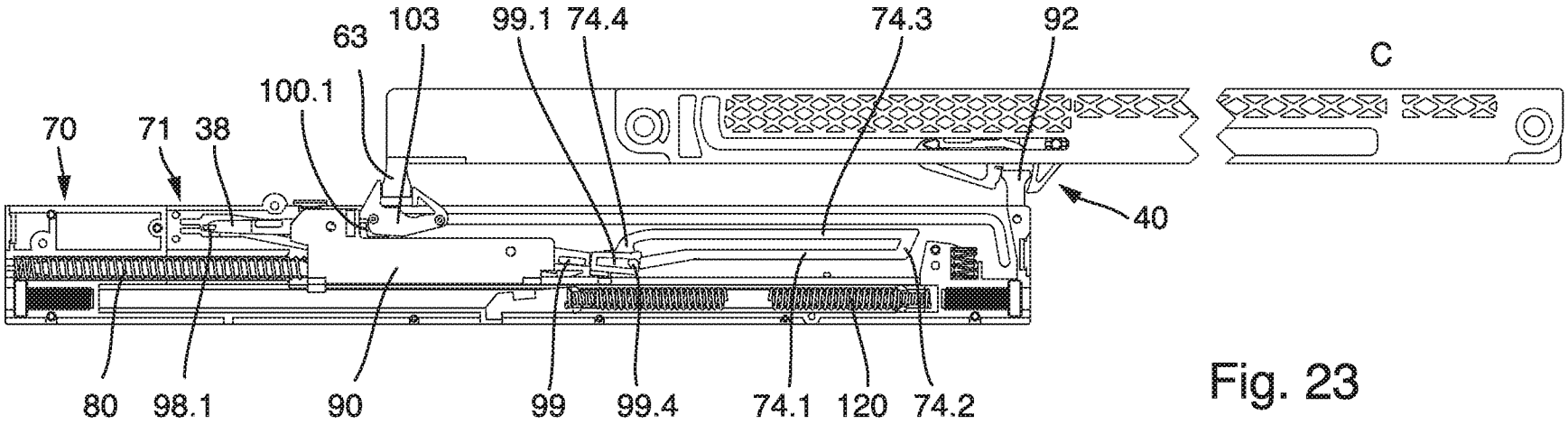

In the course of the closing movement from FIG. 21 to FIG. 23, slider 103 strikes with its stop 103.5 against countermember 100.1, as shown in FIG. 22. Because immobilizing part 100 can be displaced in a closing direction with respect to guide element 90, slider 103 entrains immobilizing part 100 at countermember 100.1. Receptacle 100.2, which is embodied as a bevel, is also continuously pulled away from delimiting element 99.2 of second switching part 99. At the same time, however, the force of energy reservoir 80 is acting. That force pushes guide element 90 farther. Second switching piece 99 can now slide, with its guide element 99.4, over the obliquely extending surface of transition portion 74.2. This movement is guided in controlled fashion, avoiding any unpleasant noise emission.

An independent fundamental inventive idea is therefore that second switching piece 99 comprises a guide element 99.4 having a delimiting element 99.2, delimiting element 99.2 being braced against a receptacle 100.2, receptacle 100.2 being continuously pulled away from delimiting element 99.2 by the action of slider 103. Receptacle 100.2 can be embodied in particular in the form of an inclined surface. This fundamental inventive idea can also be combined with features of the claims described below.

When the position shown in FIG. 23 is reached, immobilizing part 100 is then completely pulled in. First switching piece 98 is immobilized in switching module 71 (see explanations above). Both energy reservoir 80 and secondary spring 120 are preloaded. Second switching piece 99 is located in return guide 74.1 of guide track 74. FIG. 23 therefore shows the closed position C.

Figure 24:
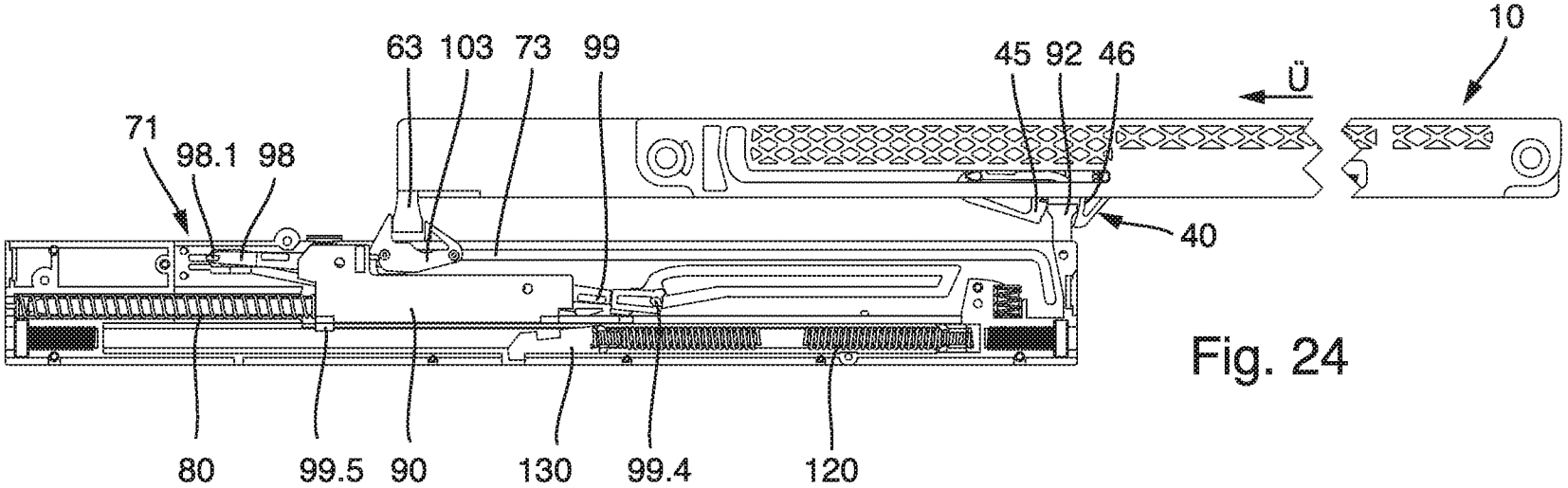
Figure 25:
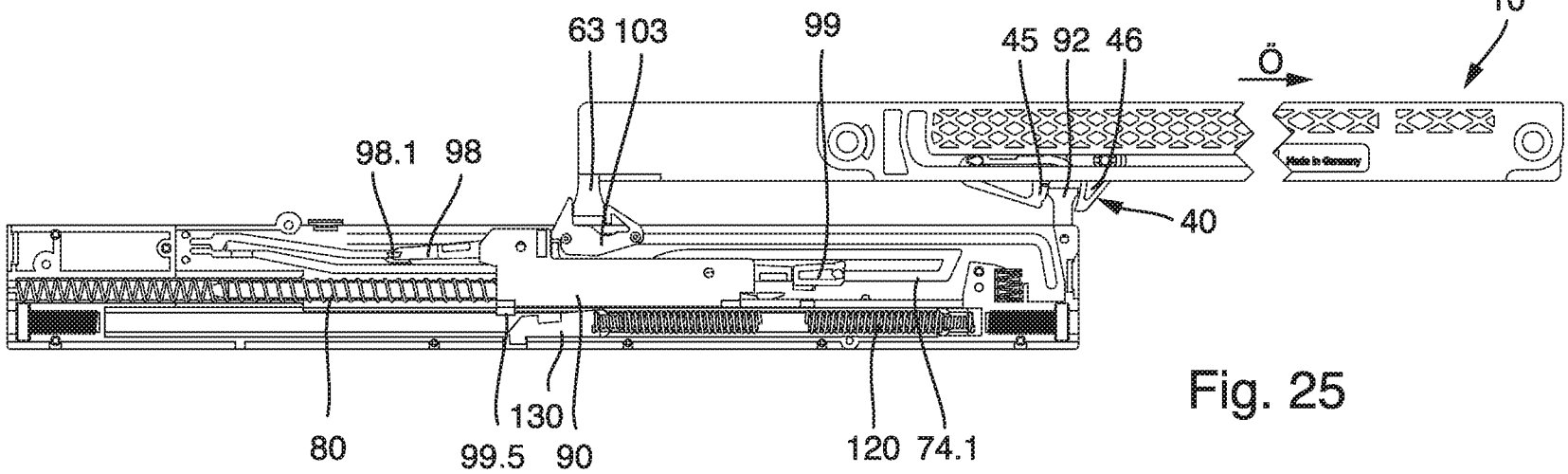
Figure 26:
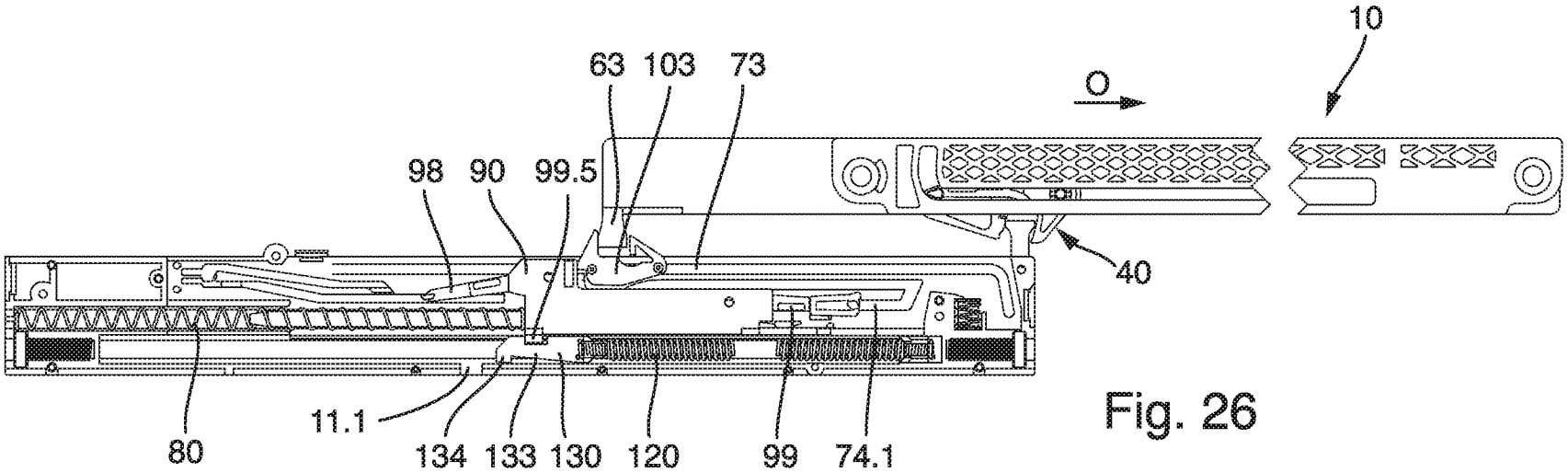

When an overtravel Ü is then applied onto the drawer as shown in FIG. 24, guide element 90 becomes shifted to the left. Guide module 71 disengages, and releases first switching piece 98. Energy reservoir 80 then pushes guide element 90 in opening direction Ö. In the course of this movement, first switching piece 98 travels out of switching module 71. Guide element 90 entrains slider 103. Because pull-in apparatus 10 is coupled to push-out assemblage 10 via coupling piece 92 and actuation piece 63, coupling element 40 of pull-in apparatus 10 becomes shifted against the force of spring 20 of the pull-in apparatus, and at the same time damping apparatus 30 is pulled out. This happens because the force of energy reservoir 80 is sufficient to load spring 20 and to pull damping apparatus 30 out. The corresponding movement situation is illustrated in FIG. 25. Second switching piece 99 slides along return guide 74.1.

The force of energy reservoir 80 continuously weakens during the displacement movement of guide element 90. Secondary spring 120 is therefore switched in as guide element 90 travels. This is shown at the transition between FIGS. 25 and 26. As these Figures illustrate, extension 99.5 strikes coupling member 130, and extension 99.5 travels into receptacle 133 of coupling member 130. A torque that acts clockwise is then introduced into coupling member 130. Coupling member 130 is thereby lifted out of its parked position shown in FIG. 25. Extension 134 comes out of engagement with receptacle 11.1. A positive connection in a pushing direction is thus established between guide element 90 and coupling member 130. Secondary spring 120 can then relax and introduce its force via coupling member 130 into guide element 90.

Figure 27:
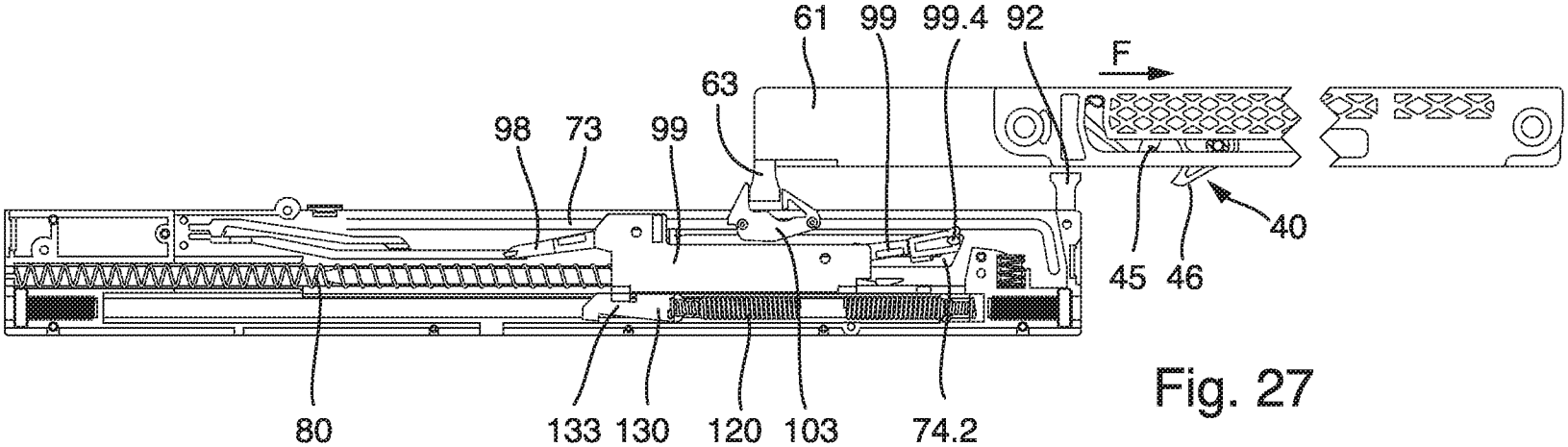

As guide element 90 continues to move, coupling element 40 comes into its tipped-over position, which is depicted in FIG. 27 and has been described above in detail. The coupling of pull-in apparatus 10 to coupling piece 92 is then thereby canceled. The drawer can be moved in free-running fashion farther in an opening direction. In that context, the pull-in apparatus entrains slider 103 a little farther via actuation piece 63, slider 103 being shifted in guide 73 until it again assumes the position shown in FIG. 18. The drawer can then be displaced further in free-running fashion F, and opened completely.

FIGS. 28 and 29 depict a further independent inventive idea that can also be combined with features of the claims that follow.

In accordance with this inventive idea, provision is made that a return spring 110 is held in or on the housing, for example in or on a housing part 70, such that slider 103, in its parked position, can be displaced against the force of return spring 110 into a second parked position.

In the present exemplifying embodiment, return spring 110 is embodied in the form of a helical spring. A different shape for return spring 110, in particular a different suitable energy reservoir of any kind, can nevertheless also be used in the context of the invention.

As is further evident from what is depicted in FIGS. 28 and 29, parking portion 73.1 is indirectly or directly adjacent to longitudinal guide 73.2 of guide 73. Slider 103 can travel into parking portion 73.1 in such a way that it exposes the receptacle constituted between switching extensions 103.1, 103.2.

FIG. 28 shows a position in which slider 103 is not in its tipped-over position. Actuation piece 63 is located behind switching extension 103.1. This situation can exist when a drawer is first installed.

When the drawer is then opened, actuation piece 63 moves against switching extension 103.1. Switching extension 103.1 is then forced by actuation piece 63 into its tipped-over first parked position. This tipped-over first parked position of slider 103, shown e.g. in FIG. 18, is nevertheless not sufficient to allow actuation piece 63 to move past switching extension 103.1. The configuration is therefore such that slider 103 can be pushed into a second parked position in which actuation piece 63 can move past switching extension 103.1. This is shown in FIG. 29. The displacement of slider 103 occurs here against the spring force of return spring 110. Return spring 110 engages for that purpose against slider 103. When actuation piece 63 has passed slider 103, the latter snaps back, actuated by return spring 110, into the initial position shown in FIG. 18. A correct association of pull-in apparatus 10 with the push-out assemblage has then been achieved.

FIG. 30 shows a further independent inventive idea. This too can be combined with features of the claims that follow.

In accordance with this inventive idea, provision is made that pull-in apparatus 10 and the push-out assemblage are installed together on one fitting. The result is therefore one unit that can be installed either on the movable furniture part or on the stationary furniture part. A follower 60 having an actuation piece 63 can be installed on the respective other furniture part. Coupling element 40 of pull-in apparatus 10, and slider 103 of the push-out assemblage, both interact with actuation piece 63 of follower 60. Coupling piece 92 shown in the previous drawings can therefore be omitted.

The configuration of pull-in apparatus 10 is evident from FIGS. 1 to 27. The configuration of the push-out assemblage is evident from FIGS. 17 to 29. Simply by suitably positioning the push-out assemblage with respect to pull-in apparatus 10 on one fitting, it is possible to implement the entire functional sequence using only one follower 60.

The invention claimed is:

1. A movement assembly for a movable furniture part, comprising:
- a push-out assembly including:
  - a housing including a guide track;
  - a guide element guided on the housing;
  - an energy reservoir configured to displace the guide element from a parked position to an ejection position relative to the housing;
  - a switching piece connected to the guide element and displaceable relative to the guide element, the switching piece including a switching piece guide structure guided in the guide track of the housing; and
  - a displaceable immobilizing part;
  - wherein the switching piece includes a delimiting element configured to come to a stop against the displaceable immobilizing part in one switched position of the switching piece; and
  - wherein the immobilizing part includes a countermember configured to be acted upon to displace the immobilizing part between a released position and an immobilized position.

2. The movement assembly of claim 1, wherein:
- the push-out assembly further includes a slider configured to displace the guide element over at least part of a travel from the ejection position toward the parked position of the guide element.

3. The movement assembly of claim 2, wherein:
- the guide element and the slider are displaceable together relative to the housing.

4. The movement assembly of claim 2, wherein:
- the housing includes a guide; and
- the slider includes at least one guide piece received in the guide of the housing.

5. The movement assembly of claim 4, wherein:
- the slider includes a protruding switching extension.

6. The movement assembly of claim 2, wherein:
- the housing includes two oppositely disposed guides; and
- the slider includes a guide holder having guide parts extending from opposite sides of the guide holder, the guide parts being received in the two oppositely disposed guides.

7. The movement assembly of claim 2, wherein:
- the housing includes a guide, the guide including a parking portion transitioning into a longitudinal guide portion; and
- the slider is received in the guide and configured such that when the slider is received in the parking portion of the guide the slider is held in a tipped-over parked position.

8. The movement assembly of claim 2, wherein:
- the guide track includes a longitudinal guide, a return guide, a first transition portion transitioning the longitudinal guide into the return guide at one end of the longitudinal guide, and a second transition portion transitioning the return guide into the longitudinal guide at another end of the longitudinal guide.

9. The movement assembly of claim 2, further comprising:

a pull-in assembly including:

a coupling element displaceable between a pulled-in position and an extended position, the coupling element being couplable to the guide element; and a follower operably engageable with the slider.

10. The movement assembly of claim 9, wherein:

the pull-in assembly and the push-out assembly are both part of one fitting.

11. The movement assembly of claim 2, wherein:

the push-out assembly further includes a return spring configured such that the slider, in a first parked position of the slider, can be displaced against a force of the return spring into a second parked position of the slider.

12. A movement assembly for a movable furniture part, comprising:

a push-out assembly including:

a housing including a guide track;

a guide element guided on the housing;

an energy reservoir configured to displace the guide element from a parked position to an ejection position relative to the housing;

a switching piece connected to the guide element and displaceable relative to the guide element, the switching piece including a switching piece guide structure guided in the guide track of the housing; and a displaceable immobilizing part;

wherein the switching piece includes a delimiting element configured to come to a stop against the displaceable immobilizing part in one switched position of the switching piece; and wherein the immobilizing part is held on the guide element and is displaceable with the guide element relative to the housing.

13. A movement assembly for a movable furniture part, comprising:

a push-out assembly including:

a housing including a guide track;

a guide element guided on the housing;

an energy reservoir configured to displace the guide element from a parked position to an ejection position relative to the housing;

a switching piece connected to the guide element and displaceable relative to the guide element, the switching piece including a switching piece guide structure guided in the guide track of the housing; and a slider configured to displace the guide element over at least part of a travel from the ejection position toward the parked position of the guide element; and a pull-in assembly including:

a coupling element displaceable between a pulled-in position and an extended position, the coupling element being couplable to the guide element; and a follower operably engageable with the slider wherein the follower includes a stop operably engageable with the slider.

14. A movement assembly for a movable furniture part, comprising:

a push-out assembly including:

a housing including a guide track;

a guide element guided on the housing;

an energy reservoir configured to displace the guide element from a parked position to an ejection position relative to the housing;

a switching piece connected to the guide element and displaceable relative to the guide element, the switching piece including a switching piece guide structure guided in the guide track of the housing;

a slider configured to displace the guide element over at least part of a travel from the ejection position toward the parked position of the guide element; and a displaceable immobilizing part, the immobilizing part including a receptacle;

wherein the switching piece includes a delimiting element braced against the receptacle of the immobilizing part; and wherein the receptacle of the immobilizing part is continuously pulled away from the delimiting element by action of the slider.

15. The movement assembly of claim 14, wherein:

the receptacle is at least partly defined by a bevel inclined relative to a direction of action of the energy reservoir.

* * * * *